US006360513B1

(12) United States Patent
Strand et al.

(10) Patent No.: US 6,360,513 B1
(45) Date of Patent: Mar. 26, 2002

(54) RESEALABLE BAG FOR FILLING WITH FOOD PRODUCT(S) AND METHOD

(75) Inventors: Aaron Strand, Plymouth; Karl L. Linck, Kohler; Judy Fischer, Plymouth; Thomas J. Spaeth, Kiel; Jerry D. Kolbe, Chilton, all of WI (US)

(73) Assignee: Sargento Foods Inc., Elkhart Lake, WI (US)

( * ) Notice: Subject to any disclaimer, the term of this patent is extended or adjusted under 35 U.S.C. 154(b) by 0 days.

(21) Appl. No.: 09/431,732

(22) Filed: Nov. 1, 1999

Related U.S. Application Data

(60) Provisional application No. 60/133,810, filed on May 11, 1999.

(51) Int. Cl.[7] ..... B65B 61/18

(52) U.S. Cl. ..... 53/412; 53/133.4; 493/213; 493/927

(58) Field of Search ..... 531/412, 133.4, 531/139.2; 493/213, 927; 383/5, 63

(56) References Cited

U.S. PATENT DOCUMENTS

| | | | |
|---|---|---|---|
| 2,248,471 | A | 7/1941 | Stroop |
| 2,761,633 | A | 9/1956 | Sindzinski |
| 2,833,461 | A | 5/1958 | Brom |
| 2,978,769 | A | 4/1961 | Harrah |
| 3,001,689 | A | 9/1961 | Burton |
| 3,054,551 | A | 9/1962 | Holbrook et al. |
| 3,073,507 | A | 1/1963 | Trewella et al. |
| 3,094,269 | A | 6/1963 | Schneider |
| 3,103,049 | A | 9/1963 | Hawley |
| 3,104,798 | A | 9/1963 | Stone |
| 3,119,549 | A | 1/1964 | Schoen |
| 3,140,030 | A | 7/1964 | Stewart |
| 3,172,443 | A | 3/1965 | Ausnit |
| 3,181,583 | A | 5/1965 | Lingenfelter |
| 3,198,228 | A | 8/1965 | Naito |

(List continued on next page.)

FOREIGN PATENT DOCUMENTS

| | | |
|---|---|---|
| EP | 914203 | 12/1960 |
| EP | 0 275 396 | 7/1988 |
| EP | 0 302 144 A2 | 2/1989 |
| EP | 0 395 362 | 10/1990 |
| EP | 0 398 731 A2 | 11/1990 |
| EP | 0 456 277 A2 | 11/1991 |
| EP | 0 457 617 A1 | 11/1991 |
| EP | 0 513 550 A2 | 11/1992 |
| FR | 1168794 | 12/1958 |
| FR | 1 546 433 | 5/1979 |
| FR | 2586650 | 3/1987 |
| IT | 581864 | 9/1958 |
| JP | 2-205559 | 8/1990 |

OTHER PUBLICATIONS

Hayssen Econ–o–matic RT's Publication No. GRBT55, USA No date available.

*Primary Examiner*—John Sipos
(74) *Attorney, Agent, or Firm*—Ryan Kromholz & Manion, S.c.

(57) ABSTRACT

A reclosable bag for filling with at least one food product. The reclosable bag generally includes at least one sheet of web material having at least two areas of structural weakness. At least one fold structure is located between and defined by the two areas of structural weakness. An opening is located generally opposite the fold structure. The reclosable bag further includes a reclosable fastener structure having an integral skirt structure of skirt web material extending therefrom. The integral skirt structure includes a distal margin. The distal margin is coupled to the web material at, at least one location between the areas of structural weakness and the opening. The reclosable fastener structure extends past the areas of structural weakness and into the fold structure. The reclosable bag capable of being filled with at least one food product through the opening.

12 Claims, 30 Drawing Sheets

U.S. PATENT DOCUMENTS

| | | | |
|---|---|---|---|
| 3,203,062 | A | 8/1965 | Ausnit |
| 3,219,084 | A | 11/1965 | Ausnit et al. |
| 3,220,076 | A | 11/1965 | Ausnit et al. |
| 3,226,787 | A | 1/1966 | Ausnit |
| 3,285,485 | A | 11/1966 | Slator |
| 3,323,707 | A | 6/1967 | King |
| 3,340,679 | A | 9/1967 | Johnson |
| 3,347,298 | A | 10/1967 | Ausnit et al. |
| 3,371,696 | A | 3/1968 | Ausnit |
| 3,380,646 | A | 4/1968 | Doyen et al. |
| 3,381,592 | A | 5/1968 | Ravel |
| 3,419,206 | A | 12/1968 | Omori |
| 3,426,396 | A | 2/1969 | Laguerre |
| 3,439,468 | A | 4/1969 | Bok |
| 3,462,332 | A | 8/1969 | Goto |
| 3,473,589 | A | 10/1969 | Gotz |
| 3,506,517 | A | 4/1970 | Naito |
| 3,532,571 | A | 10/1970 | Ausnit |
| 3,543,343 | A | 12/1970 | Staller et al. |
| 3,545,161 | A | 12/1970 | Hoshino et al. |
| 3,579,947 | A | 5/1971 | Kalman |
| 3,589,913 | A | 6/1971 | Rosenberg |
| 3,595,468 | A | 7/1971 | Repko |
| 3,619,395 | A | 11/1971 | Skendzie |
| 3,625,270 | A | 12/1971 | Skendzie |
| 3,647,485 | A | 3/1972 | Seiferth et al. |
| 3,660,875 | A | 5/1972 | Gutman |
| 3,681,890 | A | 8/1972 | Pringle, Jr. et al. |
| 3,685,562 | A | 8/1972 | Ausnit |
| 3,713,923 | A | 1/1973 | Laguerre |
| 3,740,237 | A | 6/1973 | Grindrod et al. |
| 3,780,781 | A | 12/1973 | Uramoto |
| 3,784,432 | A | 1/1974 | Noguchi |
| 3,789,888 | A | 2/1974 | James et al. |
| 3,790,992 | A | 2/1974 | Herz |
| 3,792,181 | A | 2/1974 | Mahaffy et al. |
| 3,806,998 | A | 4/1974 | Laguerre |
| 3,807,118 | A | 4/1974 | Pike |
| 3,815,317 | A | 6/1974 | Toss |
| 3,827,472 | A | 8/1974 | Uramoto |
| 3,834,113 | A | 9/1974 | Howe et al. |
| 3,839,128 | A | 10/1974 | Arai |
| 3,889,446 | A | 6/1975 | Simmons et al. |
| 3,942,304 | A | 3/1976 | Hart et al. |
| 3,948,705 | A | 4/1976 | Ausnit |
| 4,015,771 | A | 4/1977 | Sengewald |
| 4,046,408 | A | 9/1977 | Ausnit |
| 4,098,577 | A | 7/1978 | Halpern |
| 4,101,355 | A | 7/1978 | Ausnit |
| 4,136,505 | A | 1/1979 | Putman, Jr. et al. |
| 4,174,597 | A | 11/1979 | Mowli et al. |
| 4,191,230 | A | 3/1980 | Ausnit |
| 4,196,030 | A | 4/1980 | Ausnit |
| 4,235,064 | A | 11/1980 | Wenger |
| 4,235,653 | A | 11/1980 | Ausnit |
| 4,240,241 | A | 12/1980 | Sanborn, Jr. |
| 4,246,288 | A | 1/1981 | Sanborn, Jr. |
| 4,262,395 | A | 4/1981 | Kosky |
| 4,273,815 | A | 6/1981 | Gifford et al. |
| 4,277,302 | A | 7/1981 | Reid |
| 4,288,965 | A | 9/1981 | James |
| 4,290,467 | A | 9/1981 | Schmidt |
| 4,296,179 | A | 10/1981 | Wardwell |
| 4,301,925 | A | 11/1981 | Bogart |
| 4,337,889 | A | 7/1982 | Moertel |
| 4,354,541 | A | 10/1982 | Tilman |
| 4,355,494 | A | 10/1982 | Tilman |
| 4,358,979 | A | 11/1982 | Kurzbuch |
| 4,372,793 | A | 2/1983 | Herz |
| 4,391,079 | A | 7/1983 | Cherney |
| 4,391,081 | A | 7/1983 | Kovacs |
| 4,405,667 | A | 9/1983 | Christensen et al. |
| 4,423,585 | A | 1/1984 | Monsees et al. |
| 4,437,293 | A | 3/1984 | Sanborn, Jr. |
| 4,437,923 | A | 3/1984 | Waters |
| 4,468,811 | A | 8/1984 | Shaw et al. |
| 4,483,018 | A | 11/1984 | Whelan |
| 4,501,109 | A | 2/1985 | Monsees |
| 4,505,399 | A | 3/1985 | Weiner |
| 4,526,752 | A | 7/1985 | Perlamn et al. |
| 4,532,753 | A | 8/1985 | Kovacs |
| 4,532,754 | A | 8/1985 | Hokanson |
| 4,557,505 | A | 12/1985 | Schaefer et al. |
| 4,561,109 | A | 12/1985 | Herrington |
| 4,572,377 | A | 2/1986 | Beckett |
| 4,574,951 | A | 3/1986 | Weaver |
| 4,589,145 | A | 5/1986 | Van Erden et al. |
| 4,601,694 | A | 7/1986 | Ausnit |
| 4,617,683 | A | 10/1986 | Christoff |
| 4,617,785 | A | 10/1986 | Chikatani et al. |
| 4,620,409 | A | 11/1986 | McElvy |
| 4,620,467 | A | 11/1986 | Margraf et al. |
| 4,625,496 | A | 12/1986 | Ausnit |
| 4,637,060 | A | 1/1987 | Ausnit |
| 4,646,511 | A | 3/1987 | Boechmann et al. |
| 4,651,504 | A | 3/1987 | Bentsen |
| 4,653,113 | A | 3/1987 | Taylor |
| 4,655,862 | A | 4/1987 | Christoff et al. |
| 4,658,433 | A | 4/1987 | Savicki |
| 4,663,915 | A | 5/1987 | Van Erden et al. |
| 4,665,552 | A | 5/1987 | Lems et al. |
| 4,676,051 | A | 6/1987 | Hoskinson et al. |
| 4,682,366 | A | 7/1987 | Ausnit et al. |
| 4,682,976 | A | 7/1987 | Martin et al. |
| 4,691,373 | A | 9/1987 | Ausnit |
| 4,704,842 | A | 11/1987 | Boeckmann et al. |
| 4,709,396 | A | 11/1987 | Voshall et al. |
| 4,709,397 | A | 11/1987 | Voshall et al. |
| 4,709,528 | A | 12/1987 | Merkus |
| 4,709,533 | A | 12/1987 | Ausnit |
| 4,718,553 | A | 1/1988 | Adamoli et al. |
| 4,727,709 | A | 3/1988 | Zieke et al. |
| 4,736,451 | A | 4/1988 | Ausnit |
| 4,744,674 | A | 5/1988 | Nocek |
| 4,745,731 | A | 5/1988 | Talbott et al. |
| 4,749,084 | A | 6/1988 | Pereyra |
| 4,750,313 | A | 6/1988 | Kammler et al. |
| 4,759,642 | A | 7/1988 | Van Erden et al. |
| 4,779,400 | A | 10/1988 | Hoskinson et al. |
| 4,782,951 | A | 11/1988 | Griesbach et al. |
| 4,786,190 | A | 11/1988 | Van Erden et al. |
| 4,790,126 | A | 12/1988 | Boeckmann |
| 4,795,035 | A | 1/1989 | Kim |
| 4,812,074 | A | 3/1989 | Ausnit et al. |
| 4,823,961 | A | 4/1989 | Griesbach et al. |
| 4,832,505 | A | 5/1989 | Ausnit et al. |
| 4,832,768 | A | 5/1989 | Takahashi |
| 4,834,552 | A | 5/1989 | Makowka |
| 4,835,835 | A | 6/1989 | Gould |
| 4,840,012 | A | 6/1989 | Boeckmann |
| 4,846,585 | A | 7/1989 | Boeckmann et al. |
| 4,846,586 | A | 7/1989 | Bruno |
| 4,848,928 | A | 7/1989 | Ausnit |
| 4,869,048 | A | 9/1989 | Boeckmann |
| 4,874,257 | A | 10/1989 | Inagaki |
| 4,876,123 | A | 10/1989 | Rivera et al. |
| 4,876,842 | A | 10/1989 | Ausnit |
| 4,884,387 | A | 12/1989 | James |
| 4,894,975 | A | 1/1990 | Ausnit |
| 4,896,775 | A | 1/1990 | Boechmann et al. |
| 4,898,280 | A | 2/1990 | Runge |

4,909,017 A 3/1990 McMahon et al.
4,923,309 A 5/1990 Van Erden
4,925,316 A 5/1990 Van Erden et al.
4,925,318 A 5/1990 Sorensen
4,927,271 A 5/1990 Branson
4,931,327 A 6/1990 Liu et al.
4,945,714 A 8/1990 Bodolay et al.
4,949,527 A 8/1990 Boeckmann et al.
4,957,571 A 9/1990 Cipolla
4,966,470 A 10/1990 Thompson et al.
4,969,309 A 11/1990 Schwarz et al.
4,969,967 A 11/1990 Sorensen et al.
4,971,454 A 11/1990 Branson et al.
4,972,953 A 11/1990 Friedman et al.
4,989,993 A 2/1991 Barnard
4,993,212 A 2/1991 Veoukas
5,002,781 A 3/1991 Van Erden
5,005,707 A 4/1991 Hustad et al.
5,007,142 A 4/1991 Herrington
5,007,143 A 4/1991 Herrington
5,010,627 A 4/1991 Herrington et al.
5,014,856 A 5/1991 Griesbach et al.
5,020,194 A 6/1991 Herrington et al.
5,022,530 A 6/1991 Zieke
5,023,122 A 6/1991 Boeckmann et al.
5,024,044 A 6/1991 Friedrich et al.
5,024,537 A 6/1991 Tilman
5,026,563 A 6/1991 Van Erden et al.
5,035,517 A 7/1991 Edelman
RE33,674 E 8/1991 Uramoto
5,036,643 A 8/1991 Bodolay
5,036,645 A 8/1991 Schwarz
5,046,300 A 9/1991 Custer et al.
5,047,002 A 9/1991 Zieke et al.
5,050,736 A 9/1991 Griesbach et al.
5,058,761 A 10/1991 Williams
5,059,036 A 10/1991 Richison et al.
5,063,639 A 11/1991 Boeckmann
5,063,644 A 11/1991 Herrington et al.
5,064,664 A 11/1991 Hustad
5,067,208 A 11/1991 Herrington et al.
5,067,822 A 11/1991 Wirth et al.
5,070,583 A 12/1991 Herrington
5,074,416 A 12/1991 Hustad
5,077,064 A 12/1991 Hustad et al.
5,085,031 A 2/1992 McDonald
5,088,971 A 2/1992 Herrington
5,092,684 A 3/1992 Weeks
5,092,831 A 3/1992 James et al.
5,103,979 A 4/1992 Hustad
5,105,603 A 4/1992 Natterer
5,107,658 A 4/1992 Hustad et al.
5,116,301 A 5/1992 Robinson et al.
5,118,203 A 6/1992 Andronico
5,121,997 A 6/1992 La Pierre et al.
5,127,208 A 7/1992 Custer et al.
5,129,734 A 7/1992 Van Erden
5,131,121 A 7/1992 Herrington, Jr. et al.
5,147,272 A 9/1992 Richison et al.
5,161,286 A 11/1992 Herrington, Jr. et al.
5,174,096 A 12/1992 Fukuda
5,182,825 A 2/1993 Stinson et al.
5,186,543 A 2/1993 Cochran
5,188,461 A 2/1993 Sorensen
5,189,764 A 3/1993 Herrington et al.
5,198,055 A 3/1993 Wirth et al.
5,211,482 A 5/1993 Tilman
5,215,380 A 6/1993 Custer et al.
5,221,144 A 6/1993 Schwarz et al.
5,224,779 A 7/1993 Thompson et al.
RE34,347 E 8/1993 VanErden et al.
5,238,306 A 8/1993 Heintz et al.
5,254,073 A 10/1993 Richison et al.
5,255,497 A 10/1993 Zoromski et al.
5,273,511 A 12/1993 Boeckman
5,283,932 A 2/1994 Richardson et al.
RE34,554 E 3/1994 Ausnit
5,301,394 A 4/1994 Richardson et al.
5,301,395 A 4/1994 Richardson et al.
5,345,069 A 9/1994 Grindrod
5,366,294 A 11/1994 Wirth et al.
5,377,474 A 1/1995 Kovacs et al.
5,405,478 A 4/1995 Richardson et al.
5,405,629 A 4/1995 Marnocha et al.
5,417,040 A 5/1995 Davoren
5,426,830 A 6/1995 Richardson et al.
5,431,760 A 7/1995 Donovan
5,435,864 A 7/1995 Machacek et al.
5,442,837 A 8/1995 Morgan
5,442,838 A 8/1995 Richardson et al.
5,448,807 A 9/1995 Herrington, Jr.
5,448,808 A 9/1995 Gross
5,456,928 A 10/1995 Hustad et al.
5,461,845 A 10/1995 Yeager
5,480,230 A 1/1996 May
5,482,375 A 1/1996 Richardson et al.
5,485,712 A 1/1996 Cherney et al.
5,519,982 A 5/1996 Herber et al.
5,524,420 A 6/1996 Ikuta
5,525,363 A 6/1996 Herber et al.
5,529,394 A 6/1996 Davoren
5,542,902 A 8/1996 Richison et al.
5,564,259 A 10/1996 Stolmeier
5,582,853 A 12/1996 Marnocha et al.
5,660,479 A 8/1997 May et al.
5,664,299 A 9/1997 Porchia et al.
5,669,715 A 9/1997 Dobreski et al.
5,673,534 A 10/1997 Fowler
5,698,954 A 12/1997 Hirota et al.
5,711,609 A * 1/1998 Simonsen ..... 383/5
5,713,669 A 2/1998 Thomas et al.
5,715,656 A 2/1998 Pearce
5,716,155 A 2/1998 Yoshida et al.
5,722,128 A 3/1998 Toney et al.
5,769,772 A 6/1998 Wiley
5,775,812 A 7/1998 St. Phillips et al.
5,782,733 A 7/1998 Yaeger
5,806,984 A 9/1998 Yaeger
5,830,118 A 11/1998 Nicholson
5,833,791 A 11/1998 Bryniarski et al.
5,845,465 A 12/1998 Bennett
5,845,466 A 12/1998 Laudenberg
5,851,070 A 12/1998 Dobreski et al.
5,852,920 A 12/1998 Linkiewicz
5,867,875 A 2/1999 Beck et al.
5,870,887 A 2/1999 Bennett
5,896,627 A 4/1999 Cappel et al.
5,906,438 A 5/1999 Laudenberg
5,919,535 A 7/1999 Dobreski et al.
5,924,795 A 7/1999 Thompson et al.
5,938,337 A 8/1999 Provan et al.
5,956,924 A * 9/1999 Thieman ..... 53/133.4
5,964,532 A 10/1999 St. Phillips et al.

* cited by examiner

RESEALABLE BAG FOR FILLING WITH FOOD PRODUCT(S) AND METHOD

This application claims the benefit of prior co-pending provisional application Ser. No. 60/133,810, filed on May 11, 1999.

BACKGROUND OF THE INVENTION

The present invention relates generally to the field of reclosable bags and more specifically to reclosable bags that use or incorporate tamper evident, hermetic seal, and reclosable fastener assemblies or mechanisms of the slider or zipper type. The present invention is particularly concerned with a reclosable bag that may be filled with a food product at a factory or food processing plant and then sealed to protect the food product until such time as a customer purchases the reclosable bag and opens it to access the food product within.

Reclosable, typically flexible, containers are well known in the art. Such containers normally comprise a bag-like structure made from a folded web of material, like thermoplastic film. These types of containers may also include reclosable zipper structures, as well as interlocking male and female zipper elements fused, extruded, or attached to the bag sidewalls. Alternatively, the reclosable zipper structures, mechanisms, or assemblies may also be identified as slider closure systems, i.e., a closure system for slider bags and form, fill and seal technology that contain two tracks that can be interlocked and a separate part (a slider) that rides on the tracks and is used to open and/or close the tracks. The bag-like structure is created when the thermoplastic film is folded, sealed, and severed along its exposed edges.

Reclosable bags are a great convenience to the consumer. This is especially true where the food product or material contained within the bag is of a type that may not all be consumed at once, for example, shredded cheese, sliced cheese, cheese, processed cheese, deli meats, snack foods, vegetables, fruits, sweets, etc. A problem with these types of bags is achieving a design in which the food product is hermetically sealed against oxygen, atmospheric intrusion or transmission, bacteria, molds, and/or other sources of contamination, while also providing features that help to disclose to the consumer evidence of tampering without substantially interfering with the ease of use of the bag.

In addressing this problem it is also desired to achieve a design that is easy to manufacture and may be used in combination with known types of packaging machinery that use form, fill, and seal technology such as Horizontal Form Fill and Seal (HFFS) machines or Vertical Form Fill and Seal (VFFS) machines. It is also desired to achieve a design that may optionally be used in combination with Horizontal Flow Wrapper (HFW) machines; e.g., J-WRAP machines presently available from Jones Automation Company, Inc. of Beloit, Wis.

Tamper evident packaging may also require the use of several pieces of film, which must then be connected to each other. This can make manufacturing of the reclosable bag more complicated.

It is one of the objectives of the present invention to provide a reclosable bag that may be manufactured using known packaging machinery. As previously, noted, such known machinery includes HFFS machines, VFFS machines, and HFW machines. Additionally, as will be apparent to a person of skill in the art after reading the present disclosure contained herein thermoform type machines like the one disclosed in U.S. Pat. No. 4,240,241 could also be used to practice the present invention disclosed herein, after appropriate modification as the disclosure herein will make apparent.

It is also an objective to perform the manufacturing task using only one piece of parent film in combination with a reclosable zipper assembly.

Further, it is an objective of the invention to provide the manufacturer with the option of including some or all the features of tamper resistance or evidence, hermetic seal, and ease of use in the reclosable bag that is produced.

Another objective, especially with slider or zipper type structures or sliding type zippers or fasteners is ease of use. While a sliding type zipper structure is itself relatively easy to use, the bag structures include sidewalls or fin portions that extend up past the sliding type zipper structure. This interferes with the consumer's access to the food, makes it difficult to see the zipper structure, and also makes it more difficult to easily operate the zipper mechanism. This is especially true if the person opening and closing the bag is disabled, has arthritis, or another aliment, which limits the manual dexterity of that person.

Additionally, increased ease of access to the food product is an objective because the larger the zipper structure and its associated elements the smaller the opening left to the consumer to access the food product.

The present invention is believed to address these and other objectives by the unique and simple structures and methods disclosed herein.

SUMMARY OF THE INVENTION

The present invention may generally be described as a reclosable bag for filling with at least one food product. The reclosable bag includes at least one sheet of web material. The sheet of web material has at least two areas of structural weakness and at least one fold structure located between and defined by the two areas of structural weakness. The reclosable bag includes an opening located generally opposite the fold structure. (Please note that fold structure as used in the specification and claims herein is to be interpreted as broadly as possible and should include not only structures that are a fold but also any structure that has the same or similar characteristics to a fold even though said structure may be formed by non-folding means or methods such as the result of joining or fusing the edges of two or more sheets of film.) In addition, the reclosable bag includes a sliding fastener structure having a skirt structure of web material extending therefrom and located within the fold structure. The skirt structure or skirt material may be either integral to the slider fastener structure or it may be coupled, e.g., sealed or adhered, to the slider fastener structure. The skirt structure includes a distal margin that is coupled to the sheet of web material at a location between the areas of structural weakness and the opening. The web material of the reclosable fastener structure extending past the areas of structural weakness so that the reclosable fastener structure is located within the fold structure. The reclosable bag is capable of being filled with at least one food product through the opening.

The reclosable bag structure of the present invention may optionally include other features. For example, but not by way of limitation, the skirt may include an outside surface and an inside surface. The distal margin is located on the outside surface. The inside surface may include a predetermined area having a releasable adhesive material. This allows for the option of having a peelable seal, which may be used to aid in making the reclosable bag initially hermetic and may also add another reclosable/resealable feature to the bag. (Please note that the terms reclosable, resealable, and releasable, in addition to their normal meaning, are used herein, interchangeably, to describe a closed or sealed opening that may be re-opened at a predetermined time to aid in providing access to at least a portion of the contents of the bag, and then closed or sealed to allow the remaining contents to be stored in the bag for later use and/or provide evidence of tampering.)

Additionally, and more typically, the web material of the reclosable bag is substantially comprised of a predetermined portion of a roll of a parent film material. The predetermined portion having predetermined dimensions from which a reclosable bag of predetermined dimensions may be constructed. The parent film material may be manufactured to a specification which determines the shape and location of the areas of structural weakness and which makes the areas of structural weakness an integral part of the parent film. Presently, it is believed to be commercially preferred to do so. Alternatively, the areas of structural weakness could be applied to the parent film at a predetermined step of the construction or manufacturing process of the resealable bag.

Further, the areas of structural weakness may extend intermittently, continuously, and linearly, nonlinearly, or in some other predetermined pattern across a predetermined dimension of the sheet of web material. The predetermined dimension where the area of structural weakness is located may be either the length or the width of the reclosable bag, which is usually rectangular in shape, depending on whether or not it is desired to use the long edge or side of the bag or the short edge or side of the bag with the slider closure system. Use of the long edge of the bag provides for a larger opening and thus enhances the ease of access to the food material or other materials contained within the reclosable bag.

The term structural weakness is generally used to describe that area of the reclosable bag that is intentionally designed to be easily torn by the consumer to provide for evidence of tampering and to allow for easy exposure of the zipper mechanism or assembly. Nonetheless, it should be understood that use of the term structural weakness should include, without limiting its meaning, structures such as perforation, scores, microperforations, and multiple laminate materials which include a layer having an area of material or materials which are specifically designed to be easily torn. Accordingly, it should be understood that the areas of structural weakness are intentionally designed to create a predetermined tear path, which may or may not be hermetic.

Also, opening of the bag may be facilitated by the application of a tear strip (e.g., tear tape or tear string) along a predetermined surface or surfaces of the parent film. The tear strip may or may not be used in combination with a predetermined area of structural weakness.

Alternatively, the present invention may be described as a reclosable bag for filling with at least one food product and comprising at least one sheet of a web material. The sheet of web material includes a first area of structural weakness and a second area of structural weakness. (Alternatively, the areas of structural weakness may be tear areas or areas having a propensity to tear in a predetermined direction.) The sheet of web material including at least one fold structure, located between and defined by the first and second areas of structural weakness, and a fill opening. The sheet of web material further comprising a first panel coupled to the fold structure at the first area of structural weakness and a second panel coupled to the fold structure at the second area of structural weakness. A reclosable fastener structure including a male track structure and a female track structure. The male track structure including a first fin structure of web material extending therefrom and the female track structure including a second fin structure of web material extending therefrom. Each fin structure including a predetermined coupling portion. The coupling portion of the first fin structure being coupled to the first panel and the coupling portion of the second fin structure being coupled to the second panel. (please note that the seal, when it is formed, may be adjacent or near but should not be on the area of structural weakness). The reclosable fastener structure extending past the areas of structural weakness and into the fold structure. The areas of structural weakness being located below the reclosable fastener structure. The alternative reclosable bags are also capable of being filled with at least one food product through the fill opening, which is subsequently sealed.

The present invention allows the fold structure to be easily removed from the reclosable bag. More importantly the present invention allows the consumer to substantially expose the reclosable fastener structure so that it is easily accessible and the consumer does not have to be impeded by bag sidewalls or bag fin portions that extend up past the zipper structure. Finally, the present invention accomplishes this using but not limited to substantially one piece of film material.

Alternatively, the present invention may be described as a reclosable bag for filling with at least one food product. The reclosable bag may include at least one sheet of web material, at least one tear tape structure, at least one fold structure, and an opening located generally opposite the fold structure. A reclosable fastener structure including at least one integral skirt structure of skirt web material extending therefrom. The integral skirt structure including at least one distal margin. The distal margin being coupled to the web material at, at least one location between the tear tape structure and the opening. The reclosable fastener structure extending past the tear tape structure and into the fold structure. The reclosable bag capable of being filled with at least one food product.

Additionally, the reclosable bag for filling with at least one food product, may also be described as a reclosable bag including at least one sheet of web material having at least one fold structure presenting at least two sidewall structures having inside surfaces, and an opening located generally opposite the fold structure. A reclosable fastener structure including an integral skirt structure comprising a web material extending therefrom and including opposed distal margin structures. The web material of the integral skirt structure being sealed to the inside surfaces of the sidewall structures at a plurality of predetermined sealing areas. The reclosable bag may also include a barrier web material extending between and coupled to the distal margin structures.

The barrier web material of the alternative bag may alternatively extend between and be coupled to the sidewall structures. Alternatively, the barrier web material may also be coupled to predetermined sealing areas by at least one peelable seal. Alternatively, the barrier web material may include at least one area of structural weakness that extends through it along a direction generally parallel to the predetermined sealing areas.

Alternatively, the reclosable bag for filling with at least one food product of the present invention may include at least one sheet of web material having at least one predetermined tear area, at least one fold structure, and an opening located generally opposite the fold structure. A reclosable fastener structure including at least one integral skirt structure of skirt web material extending therefrom. The integral skirt structure including at least one distal margin. The distal margin being coupled to the web material at, at least one location between the tear area and the opening. The reclosable fastener structure extending past the tear area and into the fold structure. The reclosable bag capable of being filled with at least one food product.

This alternative reclosable bag structure may further include at least one piece of a header material located in a predetermined area of the fold structure. The header material may include at least one edge structure adjacent the tear area. The reclosable bag of this alternative structure may further include at least one tear tape structure coupled to the web material and adjacent to the tear area.

Additionally, the present invention may be described as a method of construction using known form-fill-and-seal machinery including but not limited to HFFS, VFFS, and HFW machines. The steps of the method of construction include 1. Folding the sheet of web material along a predetermined folding area located between the areas of structural weakness to form the fold structure. 2. Inserting the reclosable fastener into the fold structure. 3. Coupling the distal margin of the integral skirt structure to the web material. 4. Sealing the web material along at least two predetermined linear areas located generally perpendicular to the fold structure. 5. Filling the reclosable bag with at least one food product through an opening. 6. Sealing the opening. Please note that in an HFW application it is presently believed that the step four should occur last.

The method may also include a step of inserting either a tear tape or a tear string at least prior to step four. Further, a header strip could also be introduced prior to step four.

Alternatively, the web material may be slit along the fold line and the reclosable fastener assembly inserted and sealed to result in an exposed zipper structure assembly at one end of the bag.

Also, alternatively, if the reclosable bag is designed to have a gusset opposite the zipper opening then the fill opening may be sealed and the bag may be filled with product through the zipper opening.

Alternatively, the process and structure of the present invention could include a reclosable fastener assembly having two skirts or flaps of web material. The first skirt could be coupled or sealed to the parent film prior to folding the parent film. (Additionally, the first skirt could be tack or partially sealed prior to folding and then subsequently a full seal applied in the HFFS, VFFS, or HFW machine.) After folding the parent film the second skirt or flap would be sealed to the film sidewall located opposite the sidewall to which the first skirt is sealed or coupled. Construction of the bag could then be completed as disclosed herein.

DETAILED DESCRIPTION

Figure 1:
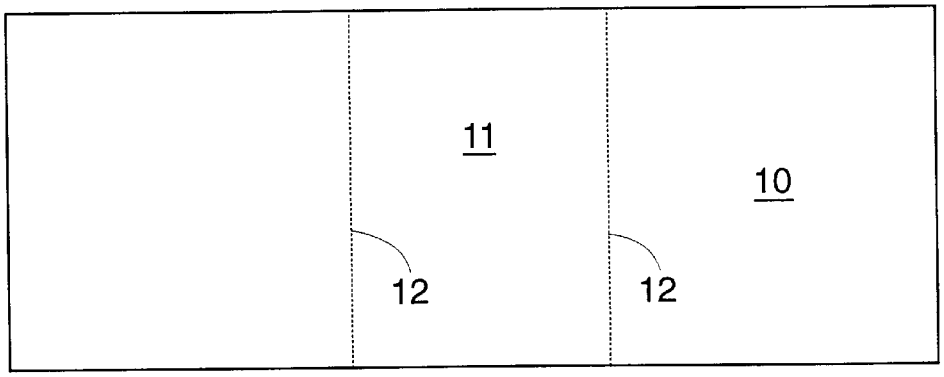
FIG. 1 is a top plan view of a predetermined portion of parent film comprising a sheet of web material including at least two areas of structural weakness.

Although the disclosure hereof is detailed and exact to enable those skilled in the art to practice the invention, the physical embodiments herein disclosed merely exemplify the invention which may be embodied in other specific structures or methods. While the preferred embodiment has been described, the details may be changed without departing from the invention, which is defined by the claims.

The present invention is both a method and a structure resulting from the method. The present invention generally relates to reclosable plastic bags 100 and, more particularly, to a reclosable plastic bags 100 having a slider or zipper assembly 20, which cooperates with a tamper-evident feature. The tamper-evident feature may also be a hermetic seal feature. The method of the present invention, while unique and fully described herein, may be used on known machinery such as, by way of illustration and not by way of limitation, the rpm 100 packaging machine manufactured by Klockner Packaging Machinery of Sarasota, Fla., U.S.A. The modifications necessary to the machinery used to practice the present invention will be apparent to a person of ordinary skill in the art after reading this disclosure.

Reclosable plastic bags using various zippers and sealing mechanisms are well known. However, the advantages of the present invention are believed not to be apparent from the known zippers and sealing mechanism of the prior art. The zipper assembly 20 typically includes a zipper structure 20*a* and an integral skirt 16. In the present invention, the skirt 16 is bonded to the parent film 10 at a predetermined seal location 14. See FIG. 3.

Referring to FIGS. 1–5, the method and structure of the present invention may begin to be generally described. Referring to FIG. 1 a predetermined portion of the parent film 10 is illustrated. The parent film 10, at predetermined locations, is structurally weakened, e.g., by the use of presently known laser scoring technology.

Figure 2:
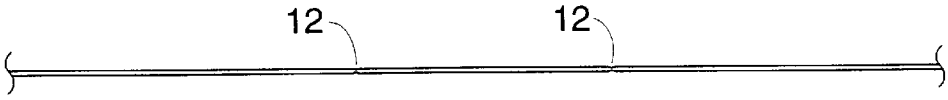
FIG. 2 is an edge elevational view of a portion of the sheet of web material of FIG. 1 and shows the location of the areas of structural weakness.

Referring to FIG. 2, an elevational edge view of the parent film 10 including the score lines 12 may be seen. The weakened area 12 may also be imperforate and hermetic. The weakened areas 12 define an integral tear off portion or fold structure 11.

Figure 3:
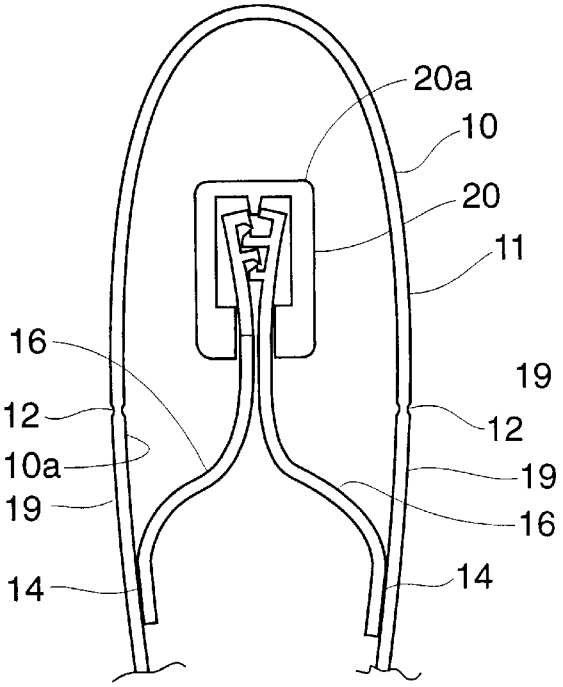
FIG. 3 is a side elevational view of the fold structure of a reclosable bag of the present invention showing the position of the slider or zipper structure in the fold structure relative to the predetermined position of the areas of structural weakness.
Figure 4:
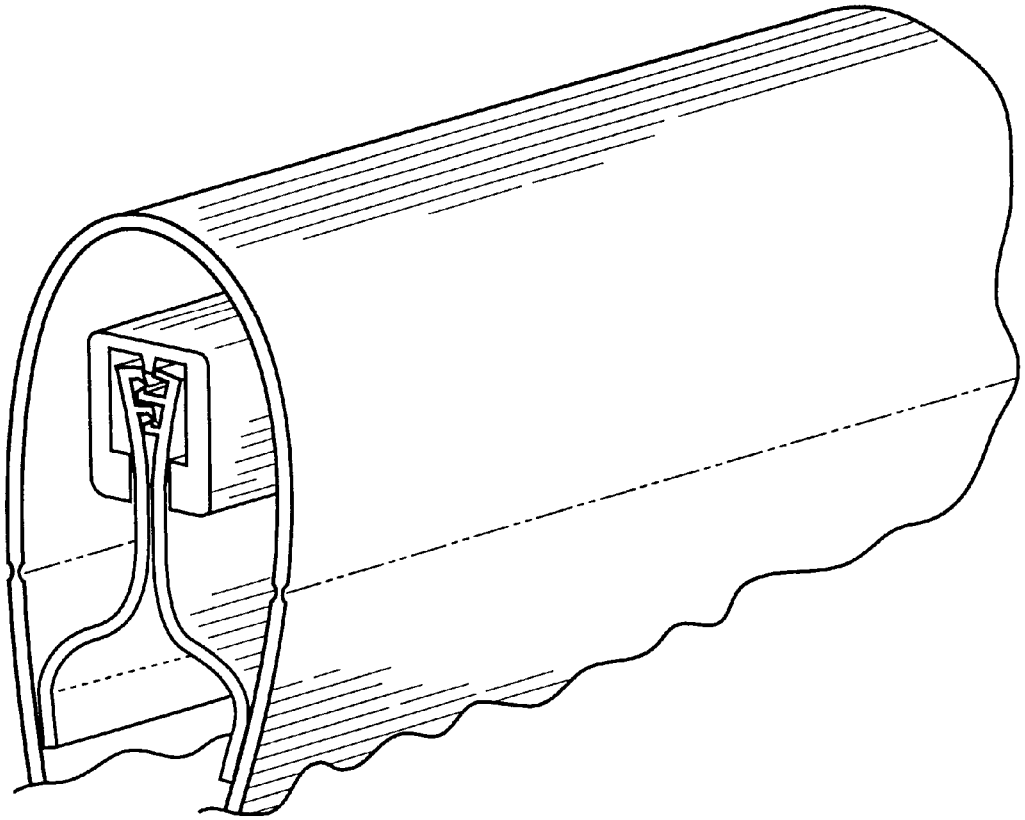
FIG. 4 is a perspective view of the embodiment shown in FIG. 3.
Figure 7:
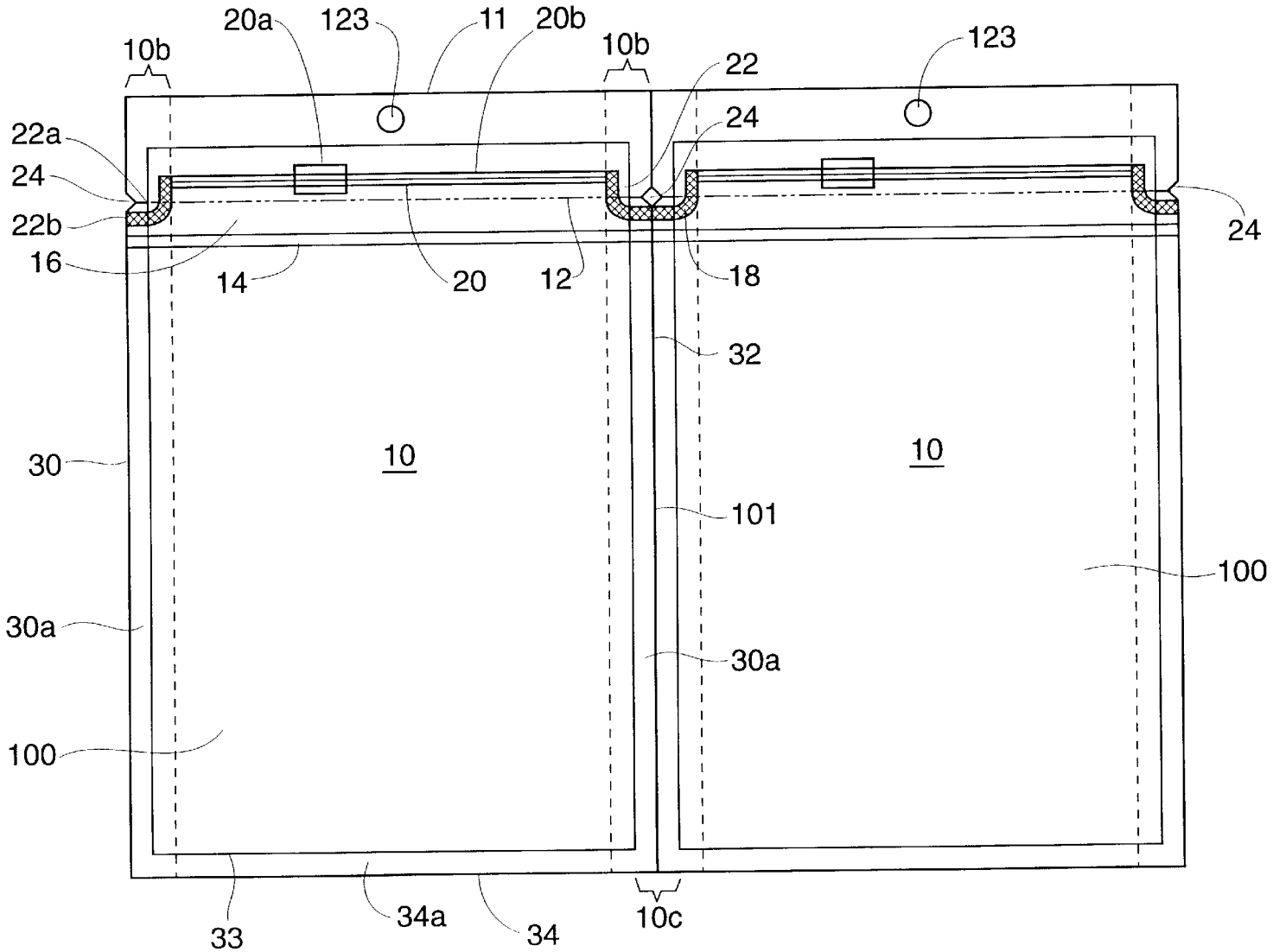
FIG. 7 is a front plan view of an alternative embodiment of the present invention.

Referring to FIG. 3, the film 10 is folded over, as shown, to form the fold structure 11 and a zipper assembly 20 is inserted. Weakened areas 12 are preferably positioned below the zipper structure 20*a* so that when fold structure or hood 11 is removed the zipper structure 20*a* is exposed sufficiently above the resulting fin structures 19 to allow the user access to the zipper structure 20*a*. Zipper skirts 16 are shown bonded to the film 10. However, it is presently believed preferable, prior to insertion of the zipper assembly 20, that the uncut ends 23 (see FIG. 5) of each zipper assembly 20 be punched out or cut to form a radiused notch 22*a*, as shown in FIG. 7. The cut zipper assembly ends 22 are sealed together (the sealed mass 22*b* of FIG. 7) which will later function to retain the contents of the bag 100 such as food.

Referring back to FIG. 3, the skirt(s) 16 remain intact so that the zipper assembly 20 is kept continuous for ease of handling. Once inserted the skirt(s) 16 of the zipper assembly 20 is bonded to the inside surface 10*a* of the parent film 10 at seal location(s) 14.

Figure 5:
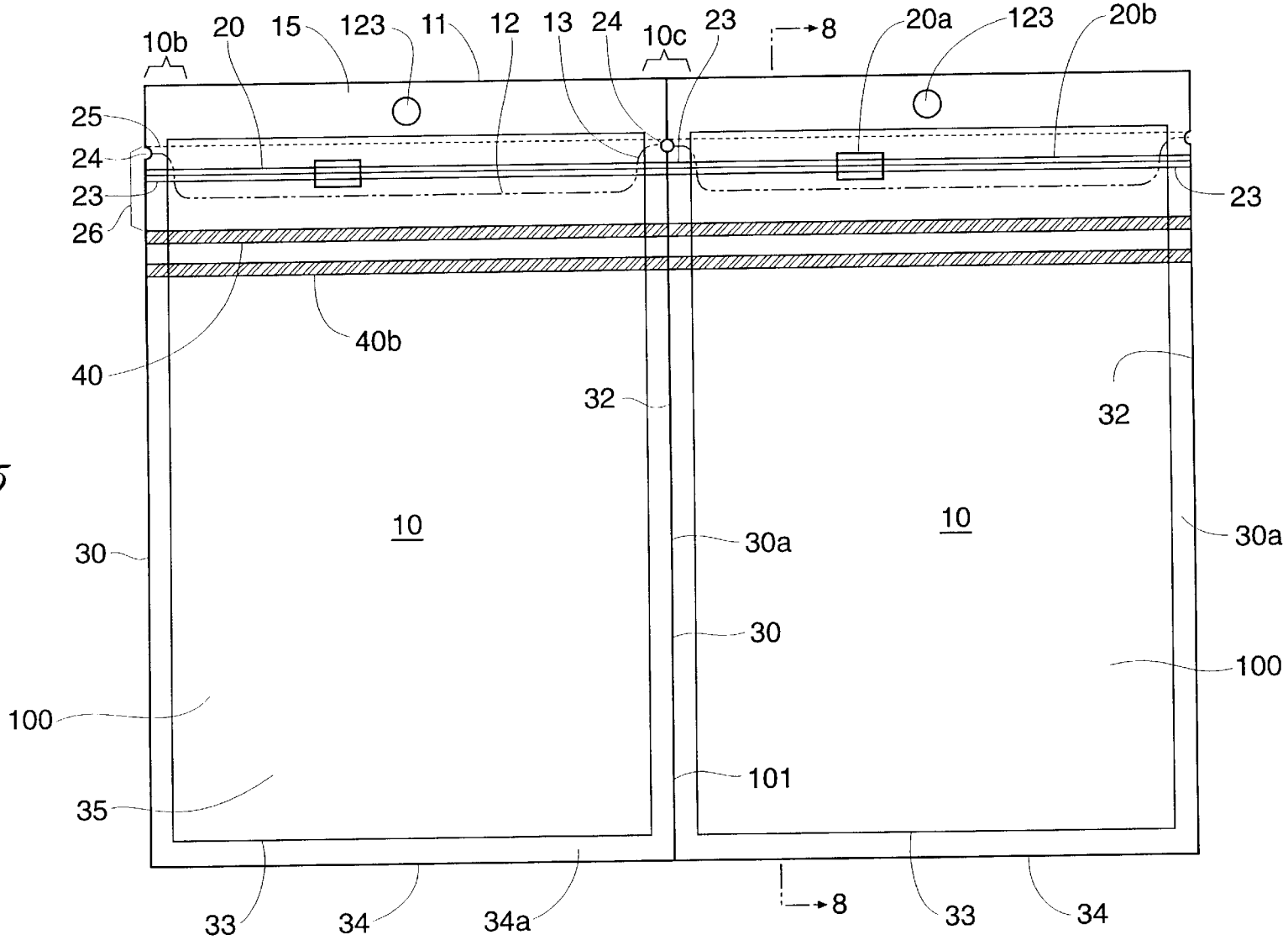
FIG. 5 is a front plan view of a first embodiment of the present invention.

Next sides 30 and 32 are sealed, along margin 10*c* illustrated in FIGS. 5 or 7, using a known mechanism such as a heat-sealing bar of a form fill and seal machine by advancing the folded film 10 to the heat sealing bar portion of the machine used; creating a seal 30*a* across the length and width of margin 10*c*. The resulting bag 100 is then filled with a predetermined foodstuff or other desired material through the opening 33 located, opposite the zipper assembly 20, at bottom edge 34 shown in FIG. 5 or 7. Then bottom edge 34 is subsequently sealed, forming seal 34*a*.

This results in the zipper assembly 20 being hermetically sealed within the tear off portion 11. Tear off portion 11 is integral to the parent film 10. Integral tear off portion 11 may be easily removed by tearing along the score lines 12, leaving the zipper structure 20*a* fully exposed and easily accessible for the use desired.

The above noted process and mechanism may also be performed so that the zipper assembly 20 is located along one of the long sides 30 or 32 of the bag 100 rather than the short side of the rectangle, which is defined by the bag 100.

Referring to FIG. 5, a second embodiment of the present invention 1 is illustrated. As may be seen from FIG. 5 two bags 100 are shown prior to their being separated along seam 101. This embodiment includes score lines 12 laid out in an alternative pattern that includes curve or arcuate section 13 and tear notch 24. As further disclosed in FIG. 5 the parent film 10 is sealed at section 26 to either its opposing sides 35 and 36 or the structure of the zipper assembly 20. The tear notch 24 provides a starting point for removing the fold structure 11, which is located above the zipper assembly 20. The fold structure 11 being defined by the location of the score lines 12. The score lines 12 extending along curve 13 to a predetermined area below the zipper assembly 20 for substantially the is entire width of the reclosable bag 100 facilitating removal of the hood or fold structure 11 and exposure of the zipper structure 20*a*. The embodiment of FIG. 5 further including a hermetic seal 40.

Figure 6:
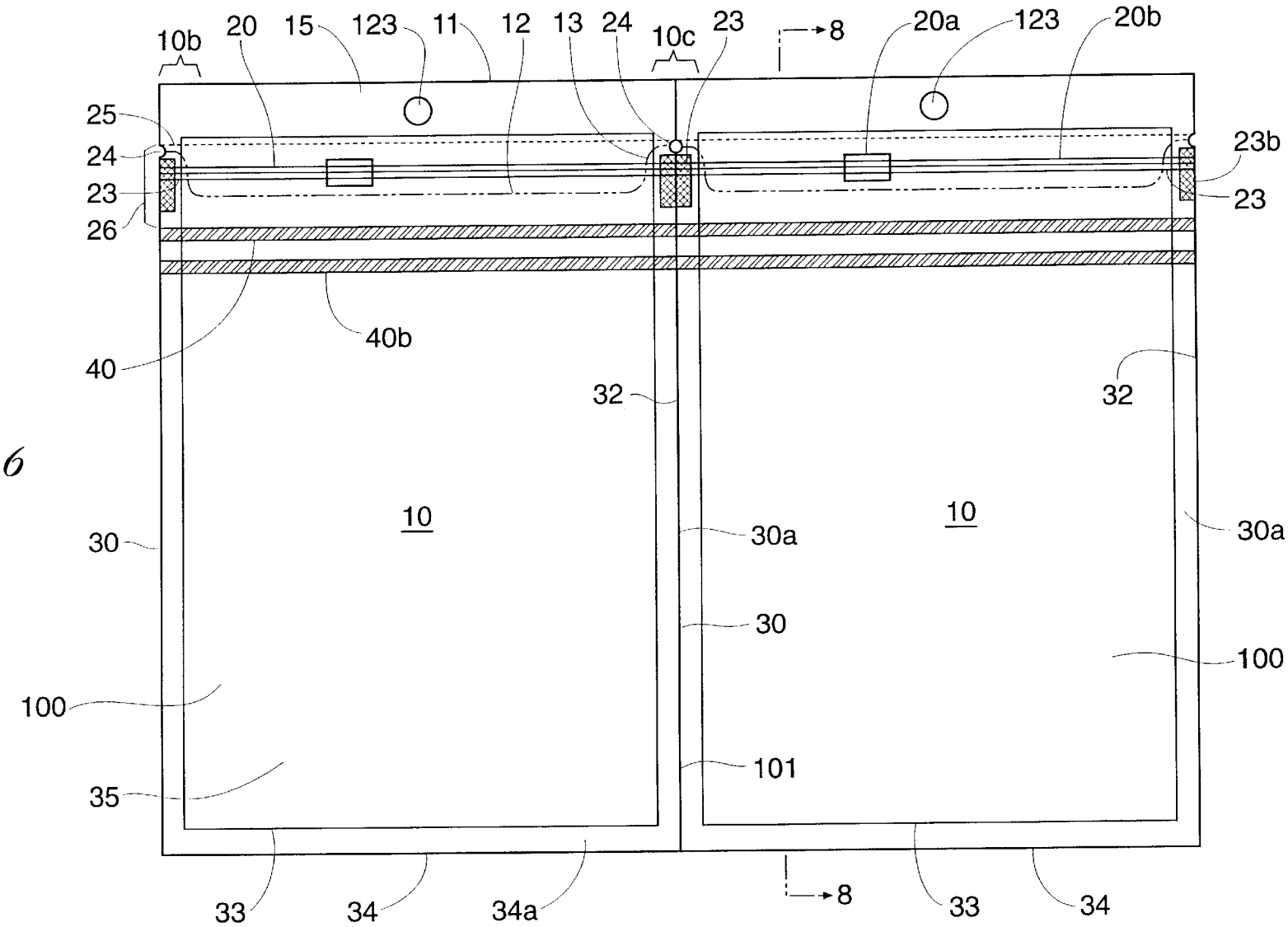
FIG. 6 is a front plan view of an alternative to the first embodiment of the present invention disclosing sealed track mass 23*b*.
Figure 8:
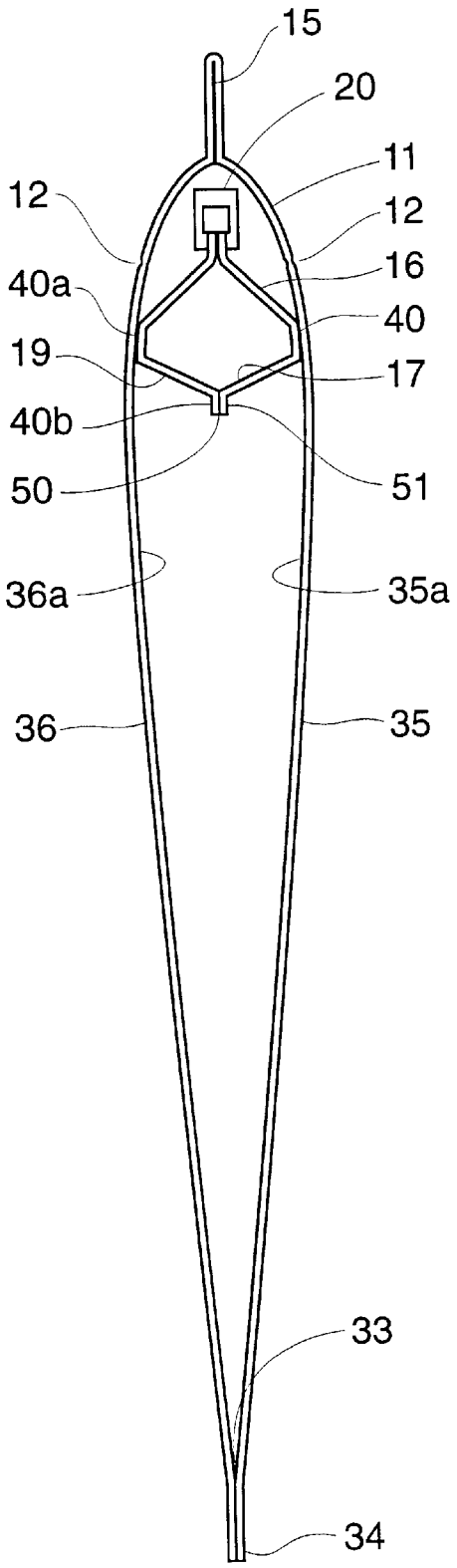
FIG. 8 is a view taken from line 8—8 of FIGS. 5 and 6.

Referring now to FIG. 8, a cross-sectional view of the embodiment of FIGS. 5 and 6 may be seen. In particular, the integral skirt 16, usually comprised of two strips on pieces of plastic film or a one-piece unit of continuous film, may be seen to have its outside surface 19 sealed hermetically to the inside surfaces 36a and 35a at respective hermetic seals 40a and 40. Additionally, a peelable seal 50 is located at the bottom of the skirt 16. Any standard commercially known resealable adhesive 51 may be used to make the peel seal 50. The peel seal 50 may also be a hermetic seal 40*b*.

Figure 9:
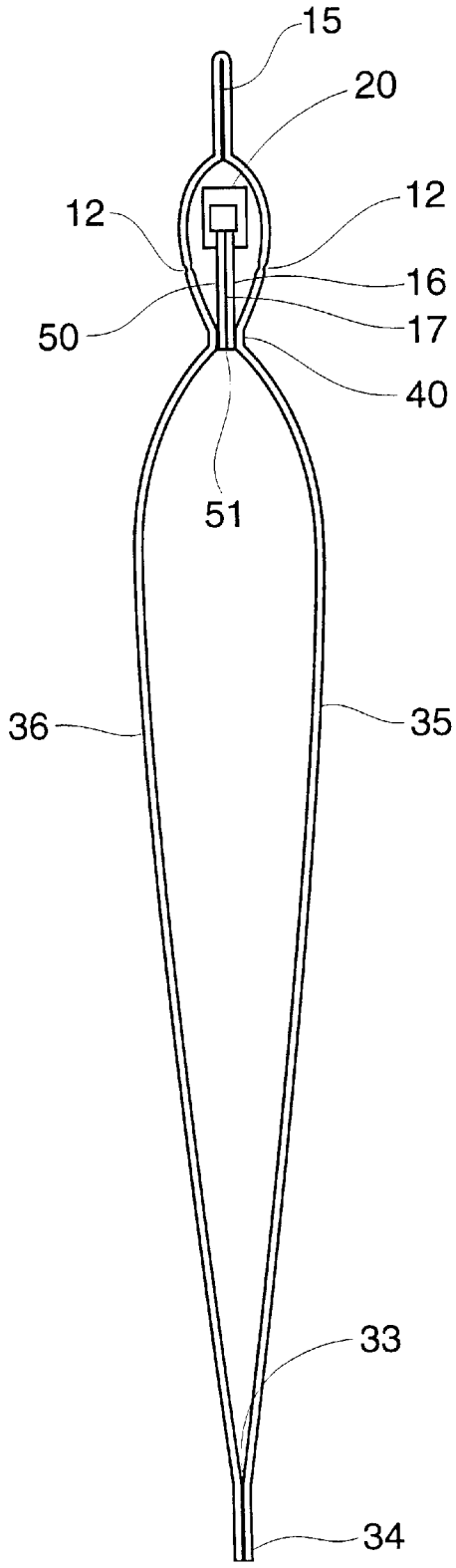
FIG. 9 is an alternative to the embodiment of the present invention shown in FIG. 8.

Referring now to FIG. 9 an alternative to the embodiment of FIG. 8 is shown. In this embodiment the zipper skirt 16 is heat sealed to the side panels 36 and 35 respectively of the parent film 10. The inside surfaces 17 of the zipper skirt 16 are peelable sealed to one another, using a known releasable adhesive 51, to provide a releasable hermetic or gas tight seal 50 therebetween. It should be noted that the term's resealable adhesive or releasable adhesive as used herein should be construed interchangeably as well as given their common meaning.

Figure 10:
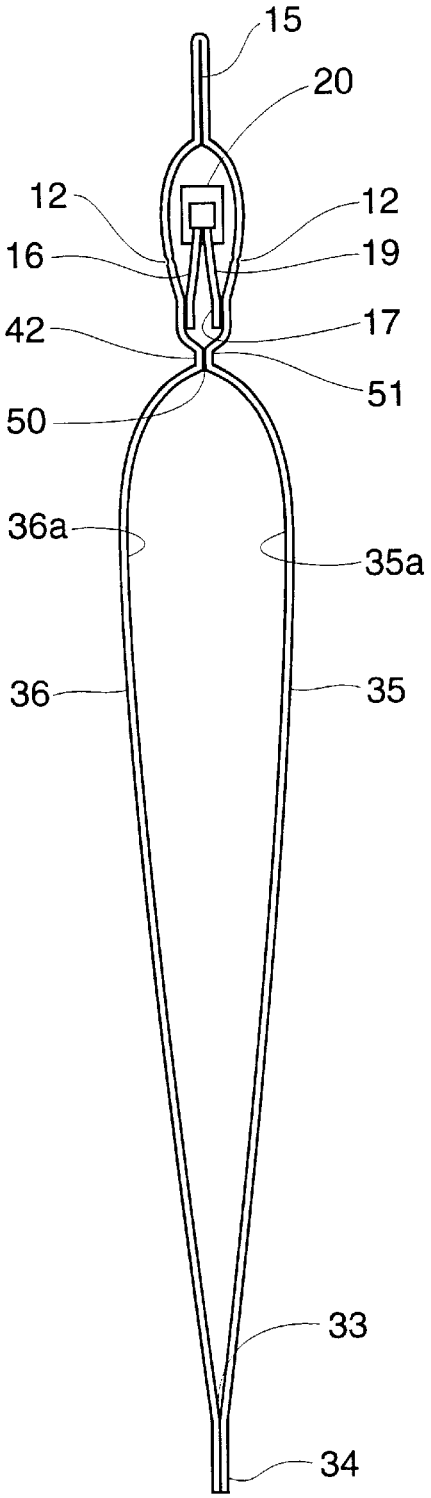
FIG. 10 is another alternative to the embodiment shown in FIG. 8.

Referring now to FIG. 10 another alternative embodiment of FIG. 8 is shown. In this embodiment the parent film 10 is sealed along a predetermined portion 42 of inside surface 35*a* and 36*a*. A known releasable adhesive 51 is used to form a peelable seal 50 between inside surfaces 35*a* and 36*a* at predetermined portion 42. U.S. Pat. No. 4,944,409 contains an example of such an adhesive. Presently, CUREX brand grade 4482-0, supplied by Curwood of Oshkosh, Wis. is considered an acceptable adhesive for use with this embodiment of the present invention.

Figure 11:
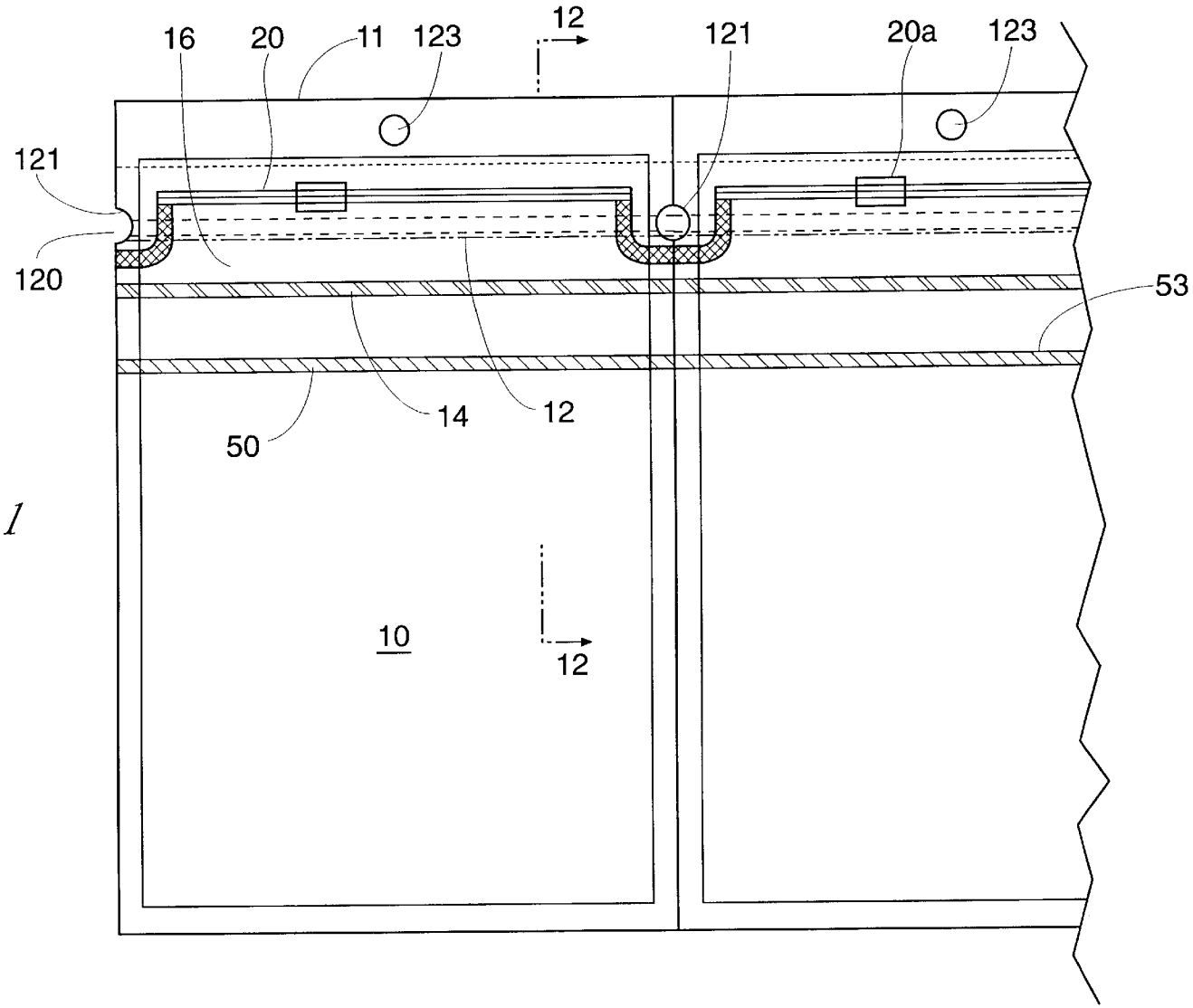
FIG. 11 is an alternative to the embodiment shown in FIG. 10 wherein a peal seal tape with a releasable adhesive located on one side of the tape is used.
Figure 12:
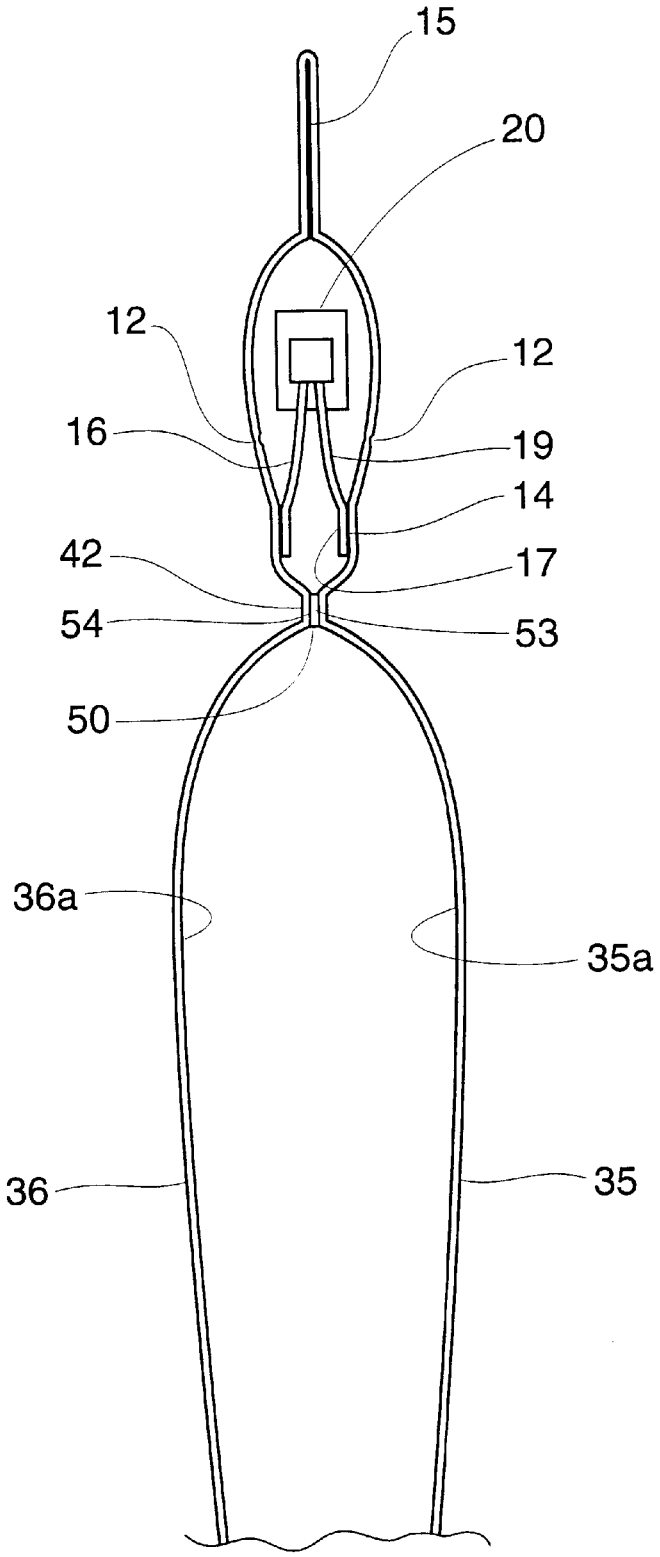
FIG. 12 is a view from line 12—12 of FIG. 11, the header material 15 that is shown, along with other structures, is optional.

Referring now to FIGS. 11 and 12 another alternative embodiment is illustrated wherein the peelable seal 50 is comprised of a peel seal tape 53 having a permanent sealant like a metallocene catalyzed polyethylene located on one side and a releasable seal material like the aforesaid CUREX brand material on the other side (side 54).

Figure 31:
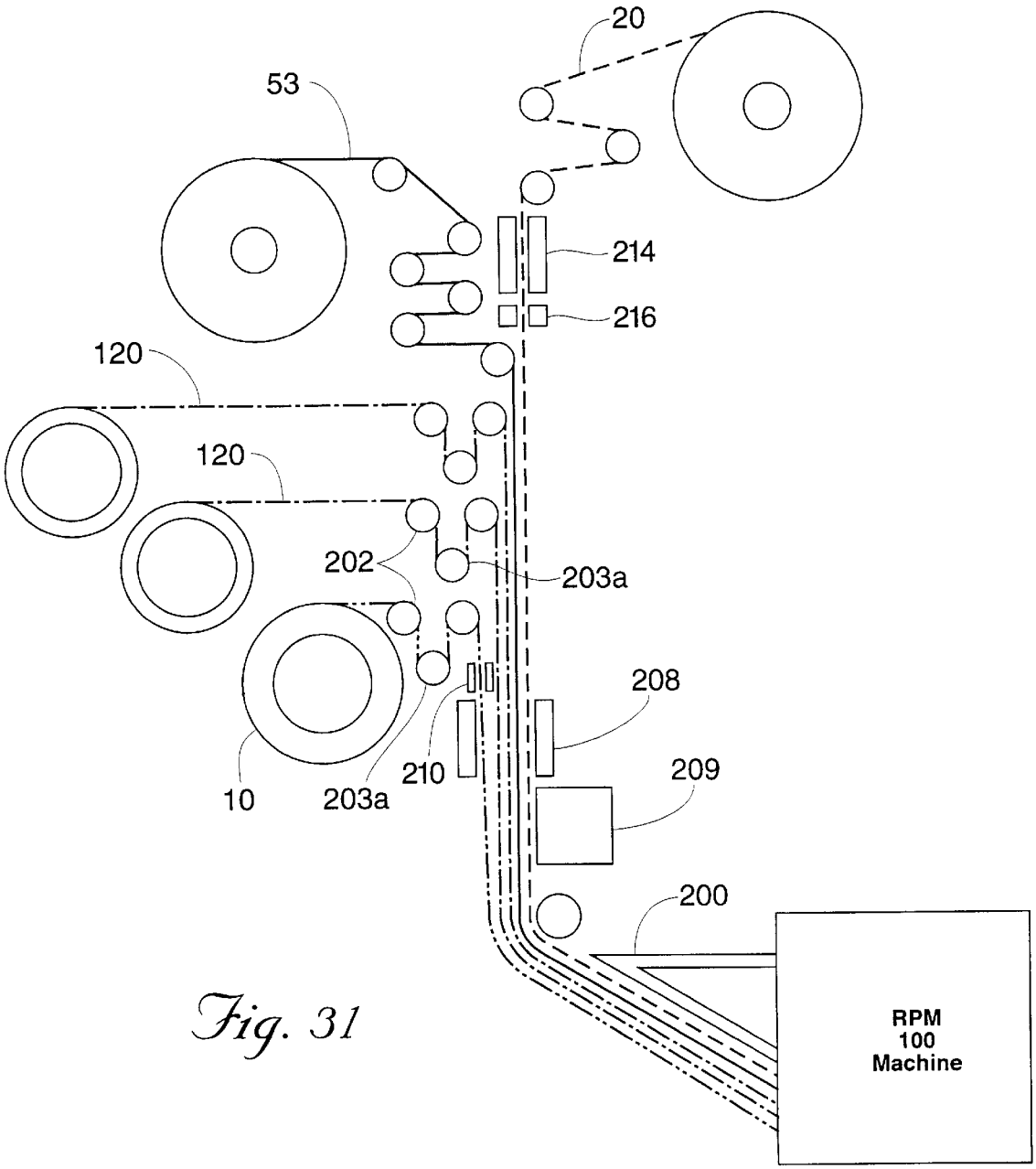
FIG. 31 is a schematic diagram showing the components of another alternative embodiment of the present invention being fed into a machine suitable for adaptation to perform the process and make at least one of the products disclosed herein before the plow structure of the machine.
Figure 33:
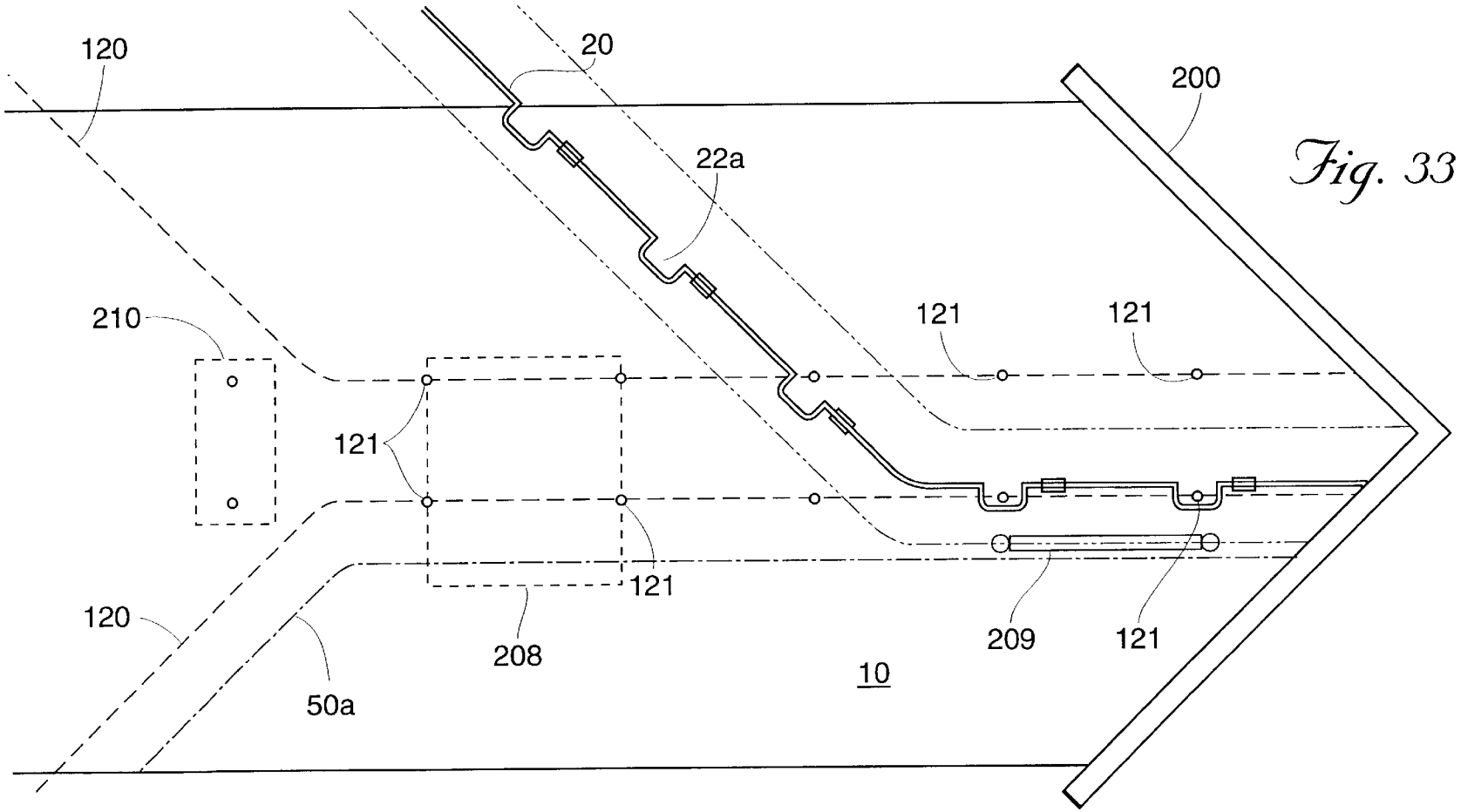
FIG. 33 is a schematic top plan view illustrating at least one method by which the components of the alternative embodiment disclosed in FIG. 31 are introduced prior to the plow mechanism of the form fill and seal machine.

One possible method for achieving the structure of FIG. 11 and 12 is the use of a form fill and seal machine system in which the peel seal tape 53 would be tacked onto a predetermined location of the parent film 10 prior to the plow 200. (See FIGS. 31, 33, and 34 for a general illustration of the location of the plow 200 in relationship to the other components of a form fill and seal machine. Please note with reference to FIG. 33 that it is presently believed preferable for heat sealer bar 208 to be enlarged sufficiently so that in addition to sealing the tear tape 120 is place it also seals the permanent seal side of the peal seal tape 53 in place at the same time. Accordingly, while one sealer bar 208 is believed preferable for these separate functions multiple bars could be used, each having a dedicated function or a combination of functions). After the plow 200 the peelable sealant side 54 would be sealed to the parent film 10 by heat sealer bars 55. Use of sealer bars 208 and 55 as disclosed herein allows independent temperatures and pressures to be used for each seal and it is believed that more consistent peel seals will result.

Figure 34:
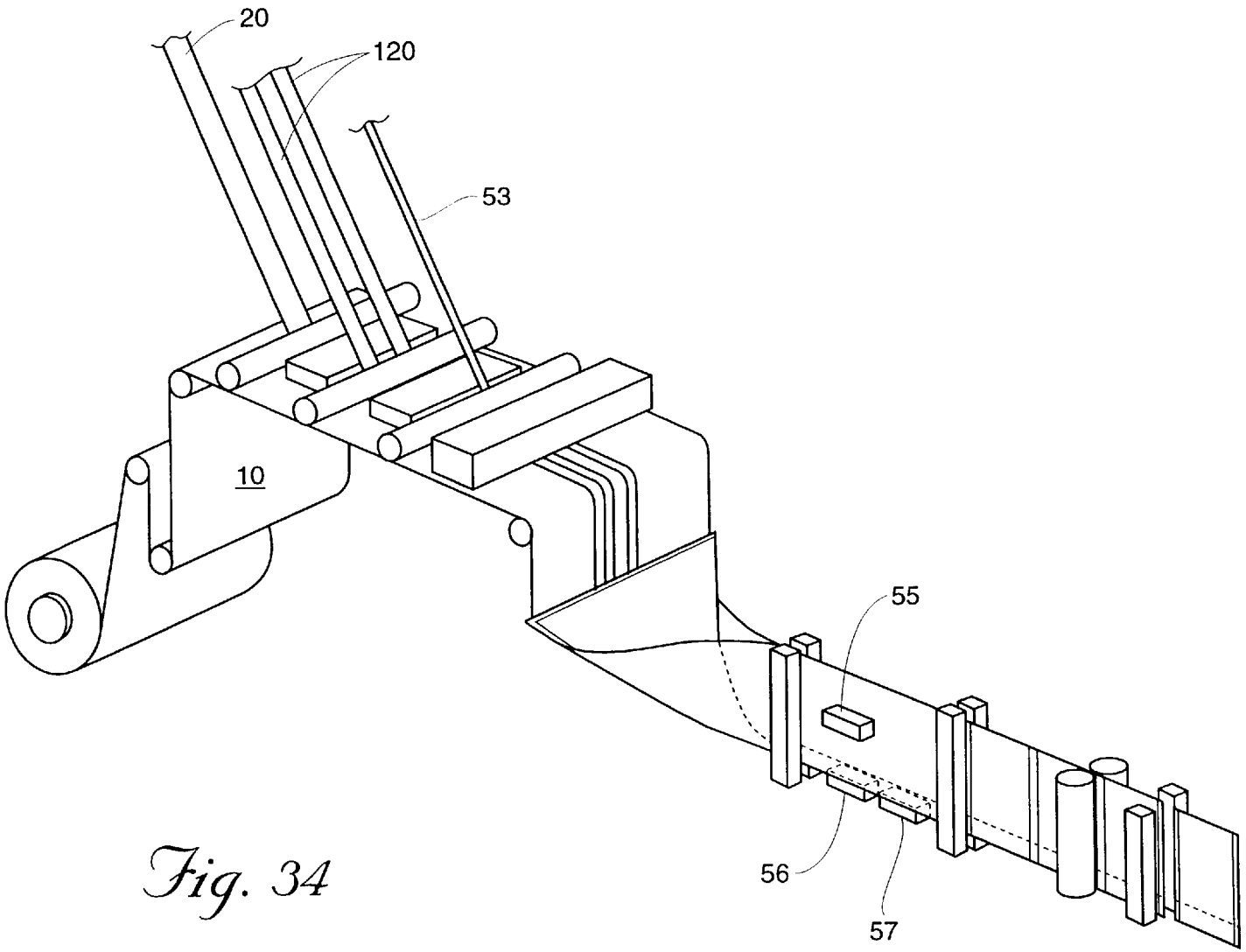
FIG. 34 is a perspective view generally showing the general relationship of the components for making the various embodiments disclosed herein. Specifically, the embodiment having the peel seal tape is disclosed although after review of this disclosure it will be apparent to a person of ordinary skill in the art how the machinery may be modified to produce the various embodiments disclosed, described, and claimed herein.
Figure 36:
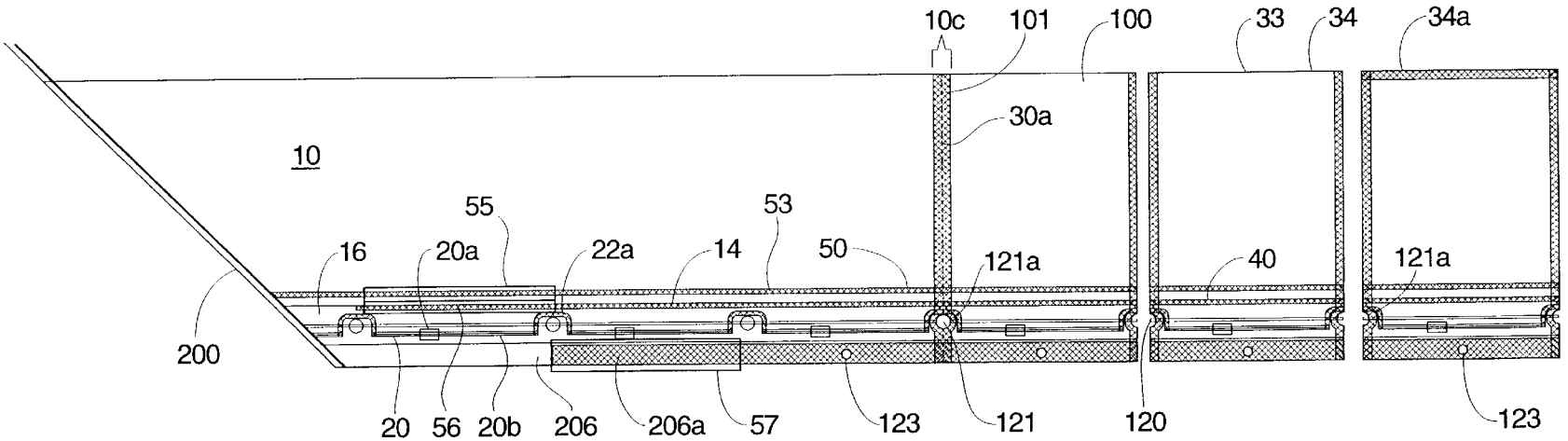
FIG. 36 is side elevational schematic view illustrating the steps of construction of the alternative embodiment disclosed in FIG. 31 subsequent to folding the parent film on the plow structure.

Additionally, the zipper skirt 16 may be sealed in place subsequent to the plow 200 by sealer bar 56 and the header seal 206*a* may be made by sealer bar 57 as illustrated generally in FIGS. 34 and 36.

Figure 13:
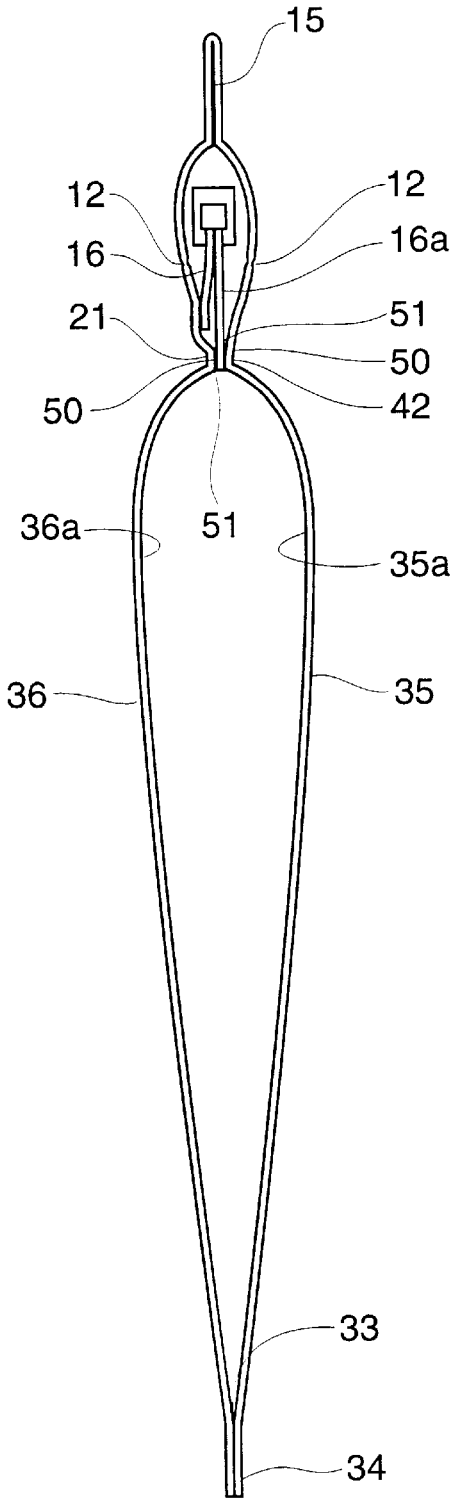
FIG. 13 is another alternative to the embodiment shown in FIG. 8.

Referring now to FIG. 13 another alternative embodiment of FIG. 10 is shown. In this embodiment, the zipper skirt 16 includes an elongated section 16*a*. End 21 of elongated section 16*a* is positioned between the inside surfaces 36*a* and 35*a* of the side panels 36 and 35 of the parent film 10. The elongated section 16*a* is heat sealed to the parent film 10 on inside surface 35*a* and peelable sealed using a known releasable adhesive 51 to inside surface 36*a* to form peel seal 50.

Figure 14:
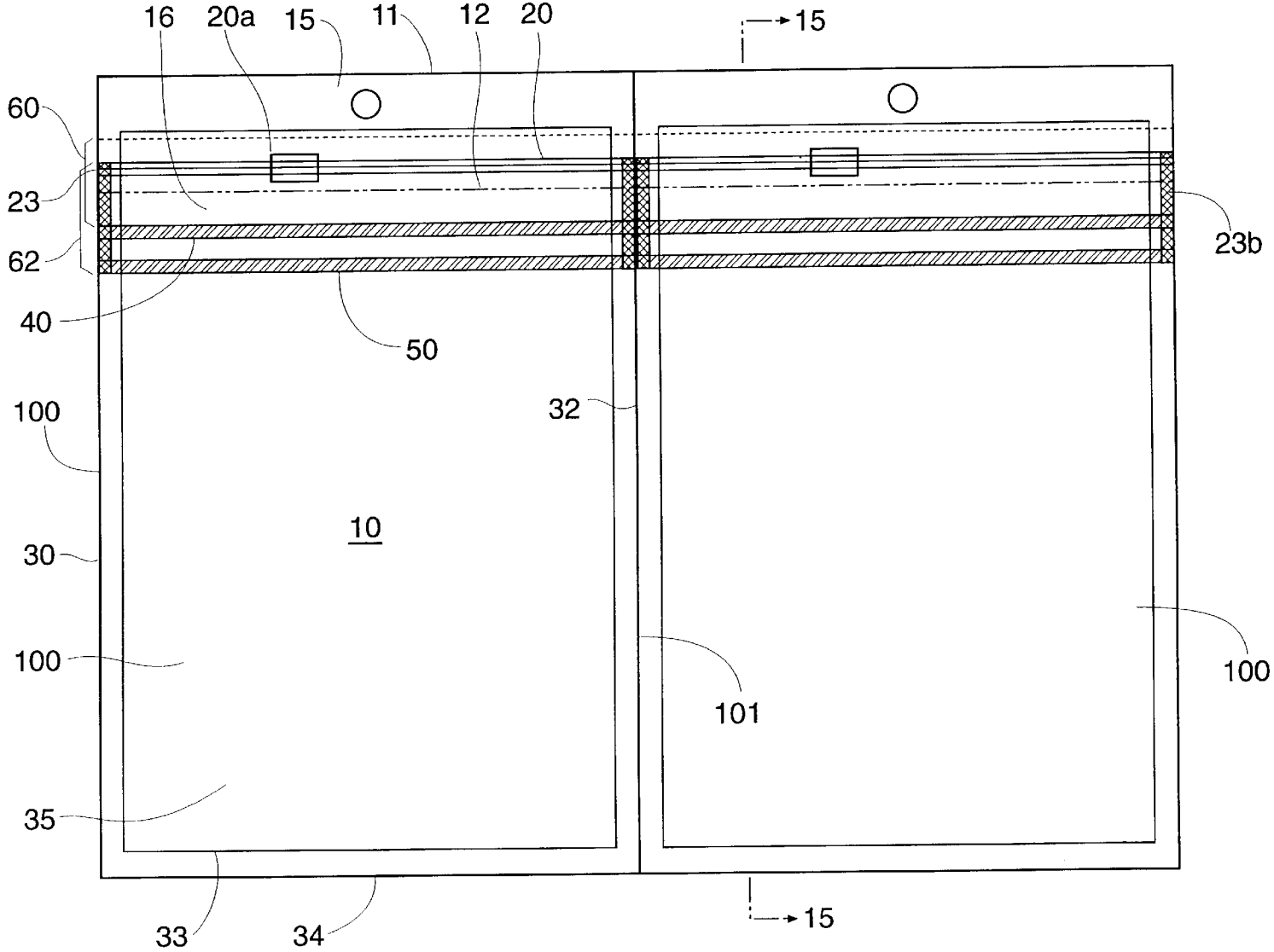
FIG. 14 is a front plan view of another alternative embodiment of the present invention.
Figure 30:
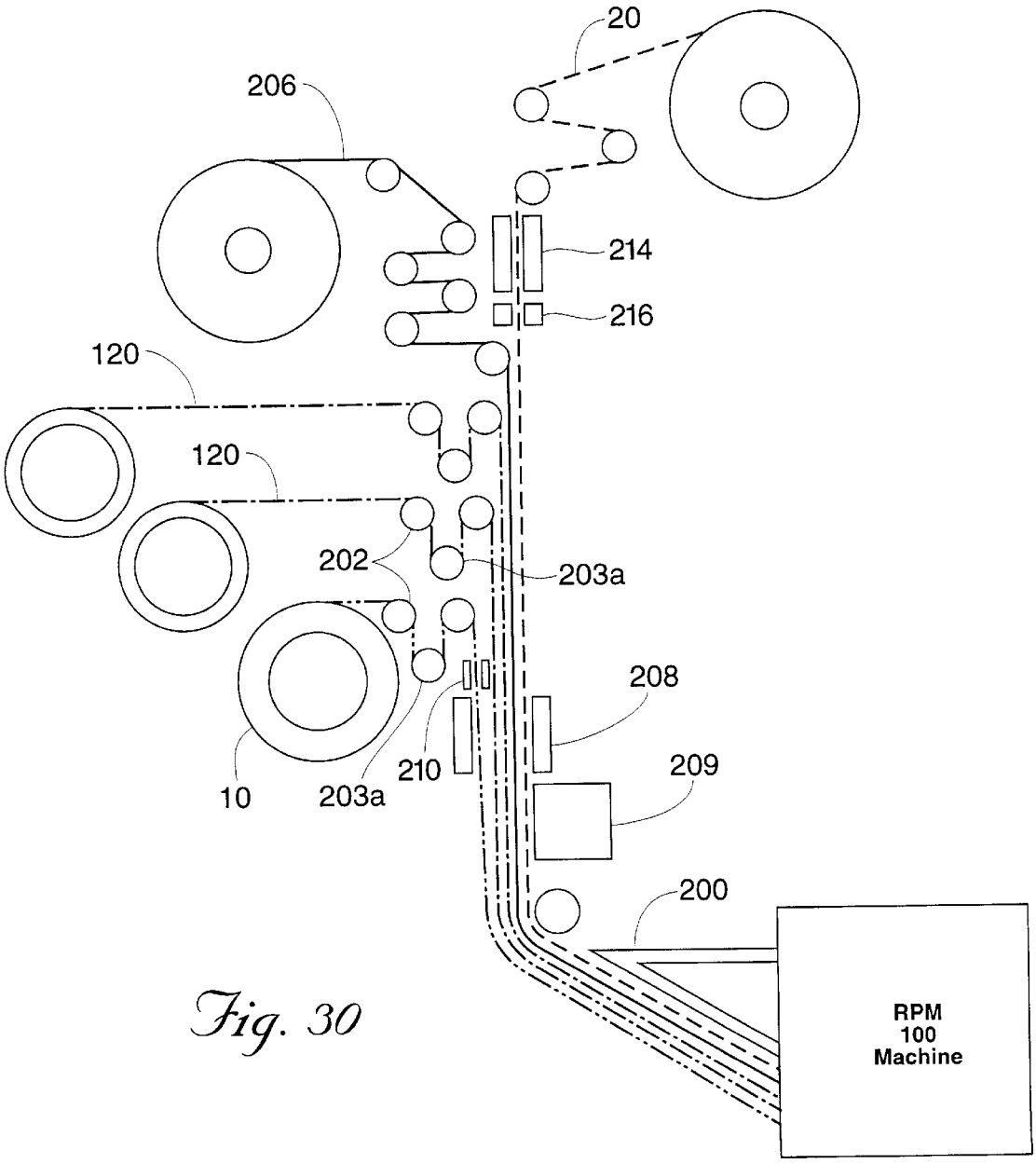
FIG. 30 is a schematic diagram showing the components of another alternative embodiment of the present invention being fed into a machine suitable for adaptation to perform the process and make at least one of the products disclosed herein before the plow structure of the machine.

Referring now to FIG. 14 a third embodiment of the present invention is disclosed. Again, two bags 100 are shown prior to their being separated along seam 101. The invention of the third embodiment is comprised of parent film 10, which is used to form the bag 100 that is to be filled. The bag 100 includes a first side seal 30, a second side seal 32, and a fill opening 33. Side panel 35 forms the front side of the bag 100. The fill opening 33, after the bag 100 is formed and filled with a predetermined type of food material, is heat sealed to form bottom edge or seal 34. The bag 100 further includes a fold structure 11, header 15, integral zipper skirt 16, a zipper assembly 20 including a zipper structure 20*a*, at least one hermetic seal 40, an unsealed area 60, and a section 62 where the zipper skirt 16 and the ends 23 of the zipper assembly 20 are heat sealed together (see sealed mass 23*b* in FIG. 14) prior to their insertion between the front side 35 and the back side 36 of the film 10. This forms sealed mass 23*b*. The formation of sealed mass 23*b* may take place at sealer 216, which is illustrated in FIG. 30.

Sealing zipper skirt(s) 16 to the parent film 10 forms the hermetic or gas tight seal 40. The zipper skirts 16 may have a predetermined portion or portions that extend past seal 40 and which may be held together with a peel seal 50. See for example, FIG. 15.

Since, within the unsealed area 60, the side panels 35 and 36 are not attached to the zipper assembly 20, the hood structure 11 (which may be defined by the score lines 12) may be easily removed to expose zipper structure 20*a*. The sealed mass 23*b* provides for containment of product when the peelable seal 50 is opened.

Figure 15:
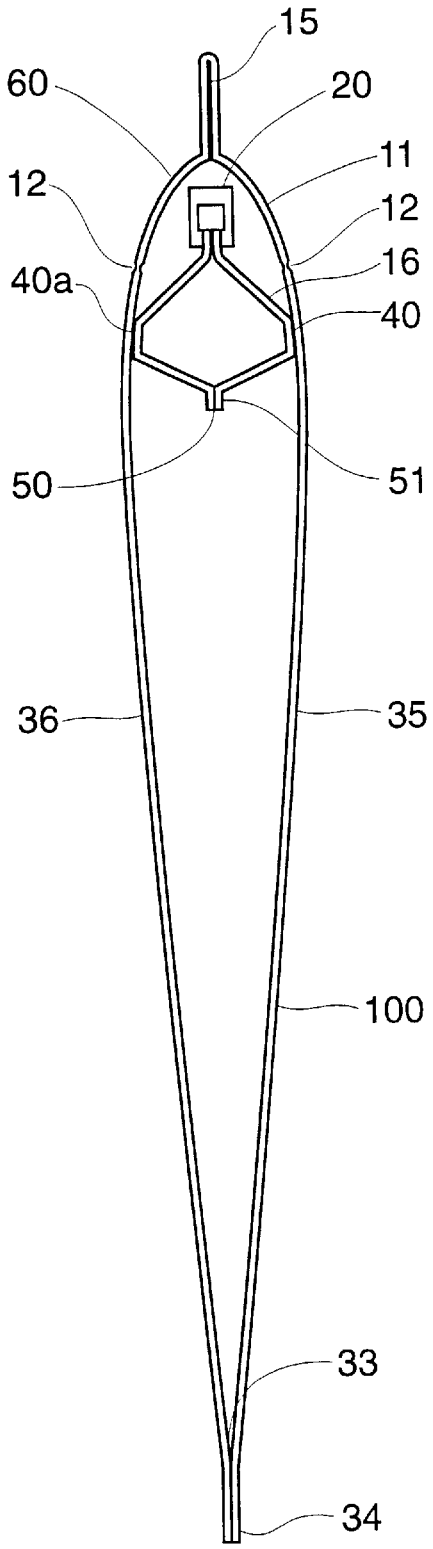
FIG. 15 is a view taken from line 15—15 of FIG. 14.

Referring to FIG. 15 a view from line 15—15 of FIG. 14 may be seen. This may be seen to be identical to the embodiment of FIG. 8, except as explained above with reference to FIG. 14.

Figure 16:
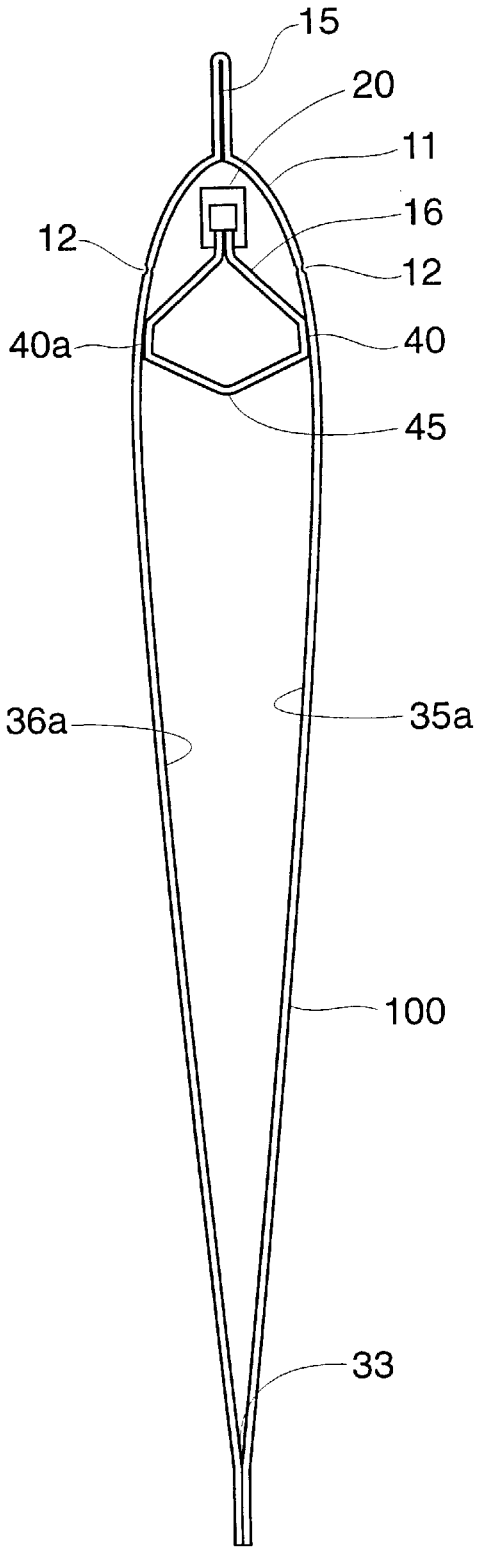
FIG. 16 is an alternative to the embodiment of the present invention shown in FIG. 15.

Referring now to FIG. 16 an alternative structure to the one shown in FIG. 15 may be seen. In this alternative, the zipper skirt 16 is made of one piece of material. It is heat sealed to the inside surfaces 35*a* and 36*a* to form hermetic seals 40 and 40*a*. The skirt 16 is provided with a structural weakness 45 which extends linearly and generally parallel to hermetic seals 40 and 40*a* along the zipper skirt 16. The structural weakness 45 is designed to fracture or tear relatively easily when the customer opens the bag 100.

Figure 17:
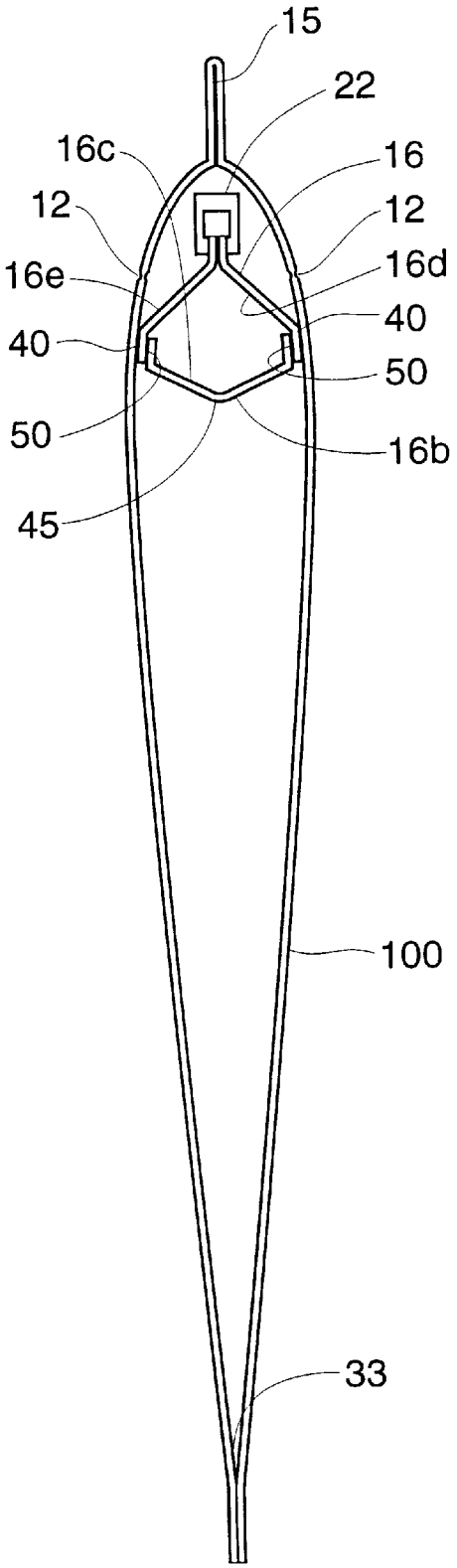
FIG. 17 is another alternative to the embodiment shown in FIG. 15.

Referring now to FIG. 17, an alternative to the embodiment shown in FIG. 16 may be seen. In this embodiment the zipper skirt 16 includes a barrier film section 16*b*. The barrier film 16*b* is applied (preferably by heat sealing although other methods could be used, e.g., Adhesive coupling, ultrasonic or high frequency sealing technology) to the inside surface 16*d* of the zipper skirt 16. The zipper skirt 16 is heat sealed along a predetermined portion of its outside surface 16e to parent film 10 to form a hermetic seal 40. The barrier film section 16*b* is releasably sealed to the inside surface 16*d* to form at least one peel type seal 50. Note that it is presently believed that section 16*b* must have a surface 16*c* that is resistant to heat sealing.

Figure 18:
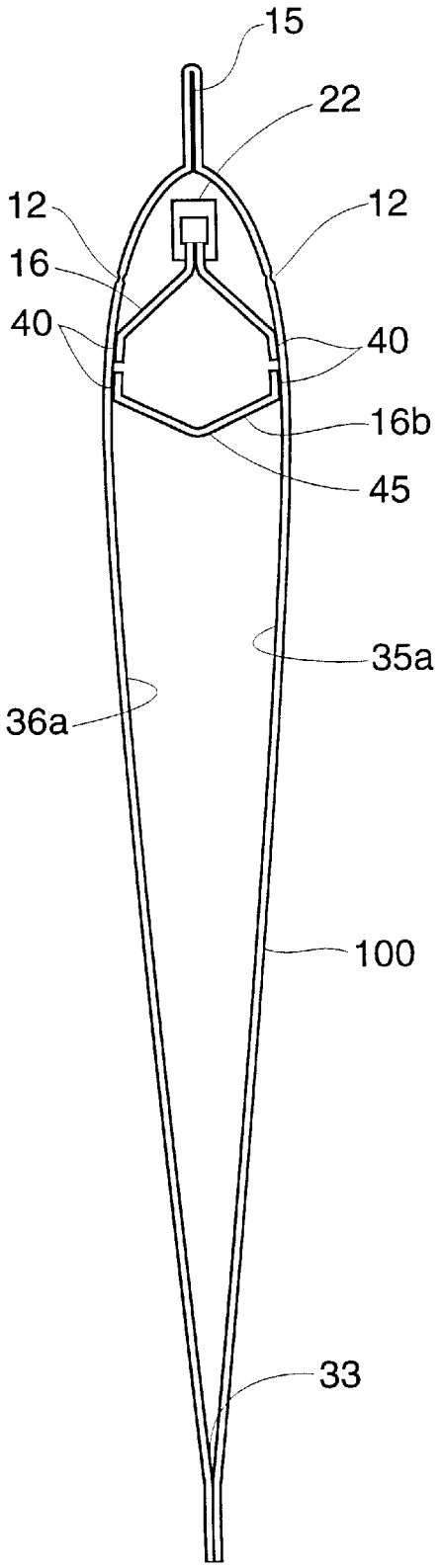
FIG. 18 is another alternative to the embodiment shown in FIG. 15.

Referring now to FIG. 18 an alternative to the embodiment shown in FIG. 17 may be seen. In this embodiment barrier film section 16*b* is heat sealed to a separate predetermined portion of the inside surfaces 35*a* and 36*a* of the parent film 10. To form two additional hermetic seals 40 located below the hermetic seals 40 of the zipper skirt 16. The barrier film 16*b* is provided with a structural weakness at 45 which extends linearly and generally parallel to hermetic seals 40. The structural weakness is designed to fracture or tear relatively easily when the customer opens the bag 100.

Alternatively, the structure of FIG. 17 could be provided with a structural weakness 45 as described with reference to FIG. 18. In such a case peel seal 50 would be replaced with a permanent seal.

Figure 19:
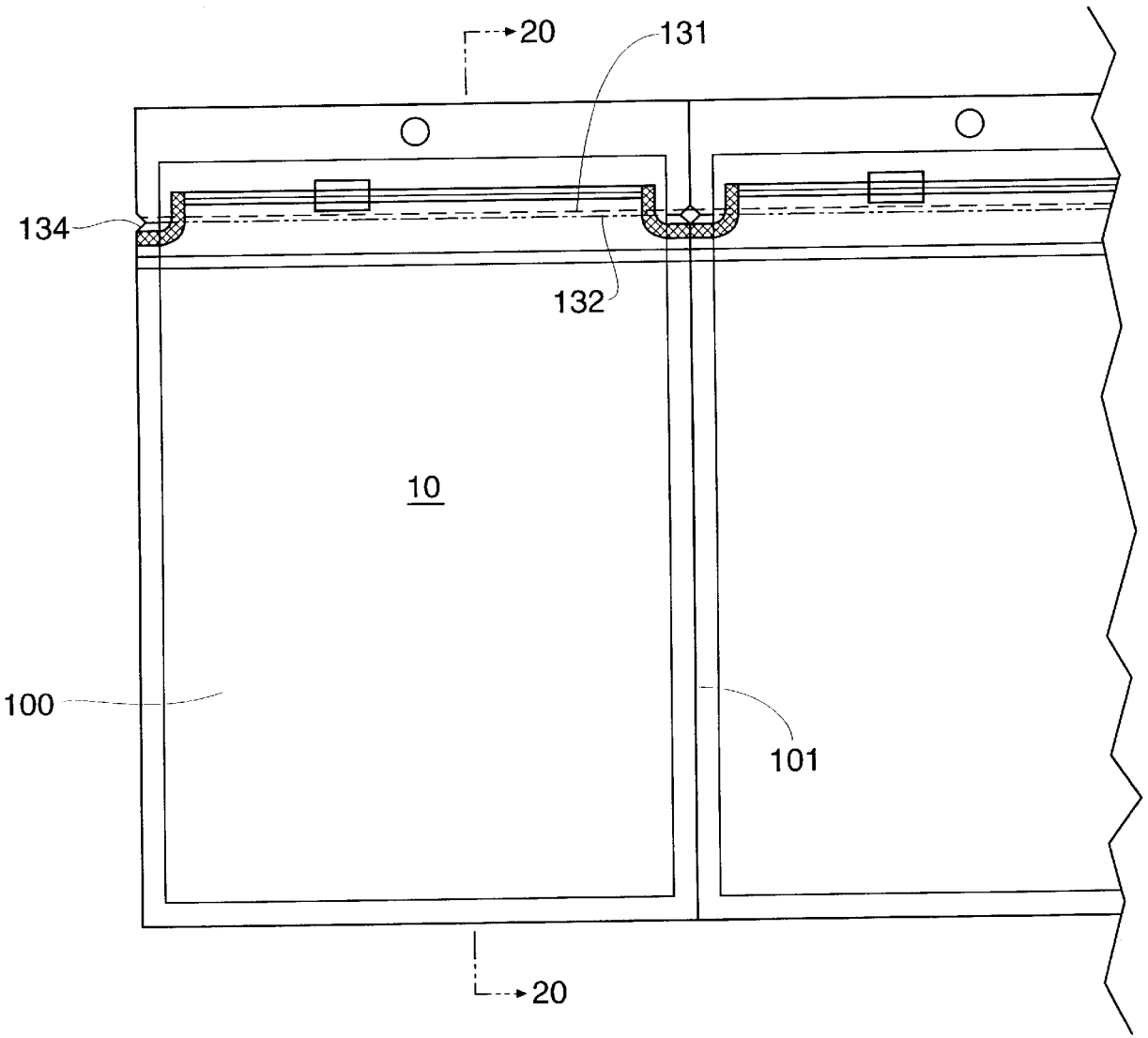
FIG. 19 is a front plan view of an alternative embodiment of the present invention.
Figure 20:
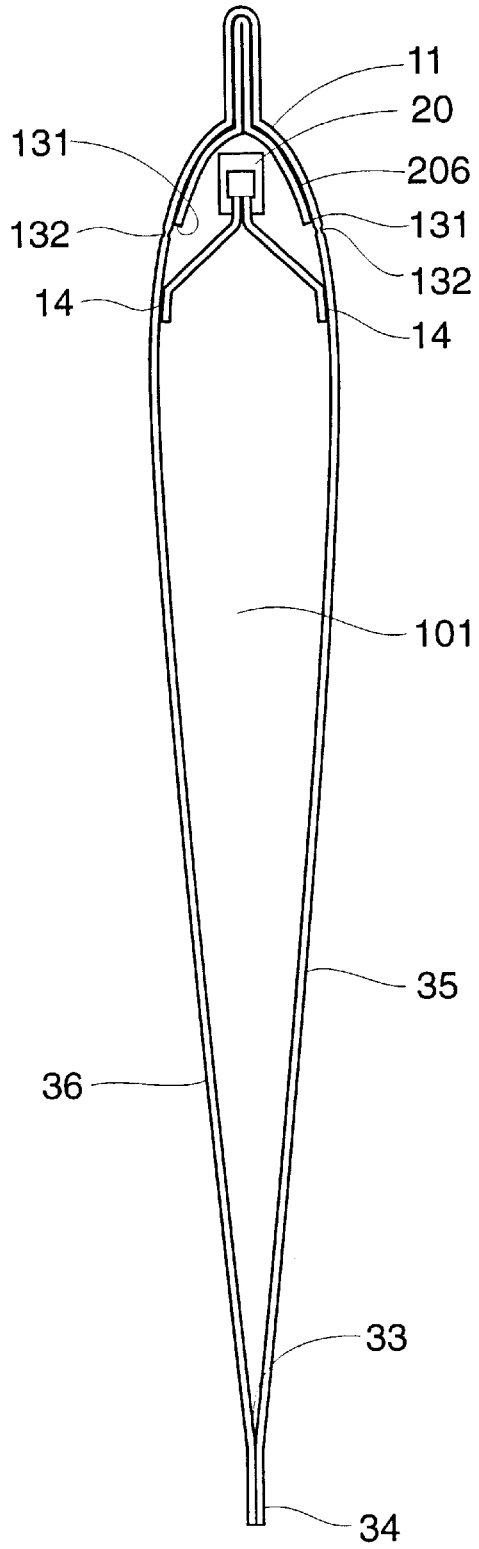
FIG. 20 is a view from line 20—20 of FIG. 19.

Referring to FIGS. 19 and 20, header strip 206, located between the front side 35 and back side 36 of the parent film material 10, of a predetermined size have sufficient width to extend down to, preferably just above, a tear line 132 (area of structural weakness). The header strip 206 terminates at edge(s) 131. This tear line 132 has the predetermined propensity to tear in predetermined way. The extension of the header strip material 206 extends down so that it is adjacent to the tear line 132. This facilitates tearing off the hood structure 11 from the bag 100 along the tear line 132. The optional tear notch 134 facilitates initiation of the tear, the tear line 132 (the oriented parent film 10 or film 10 with the propensity to tear) directs the tear, and the header material 206, which is bonded or sealed to the front side 35 and back side 36 of the parent film 10, controls the tear so that the zipper structure 20*a* is consistently clear of the parent film material 10 after the removal of the hood structure 11.

Alternatively, if the header material 206 is made of an oriented polypropylene having at least one side with a heat sealable sealant then the parent film 10 would not need to be oriented or have the tear line 132 or propensity to tear. Presently, it is believed preferable that if the header material 206 is made of an oriented polypropylene then the oriented polypropylene should have both its sides coated with a heat sealable sealant. Also, alternatively, a plurality of header strips 206 could be used instead of a single integral header strip 206. In either case, the parent film 10 would not necessarily need to be oriented or have a tear line 132 or a propensity to tear.

Figure 21:
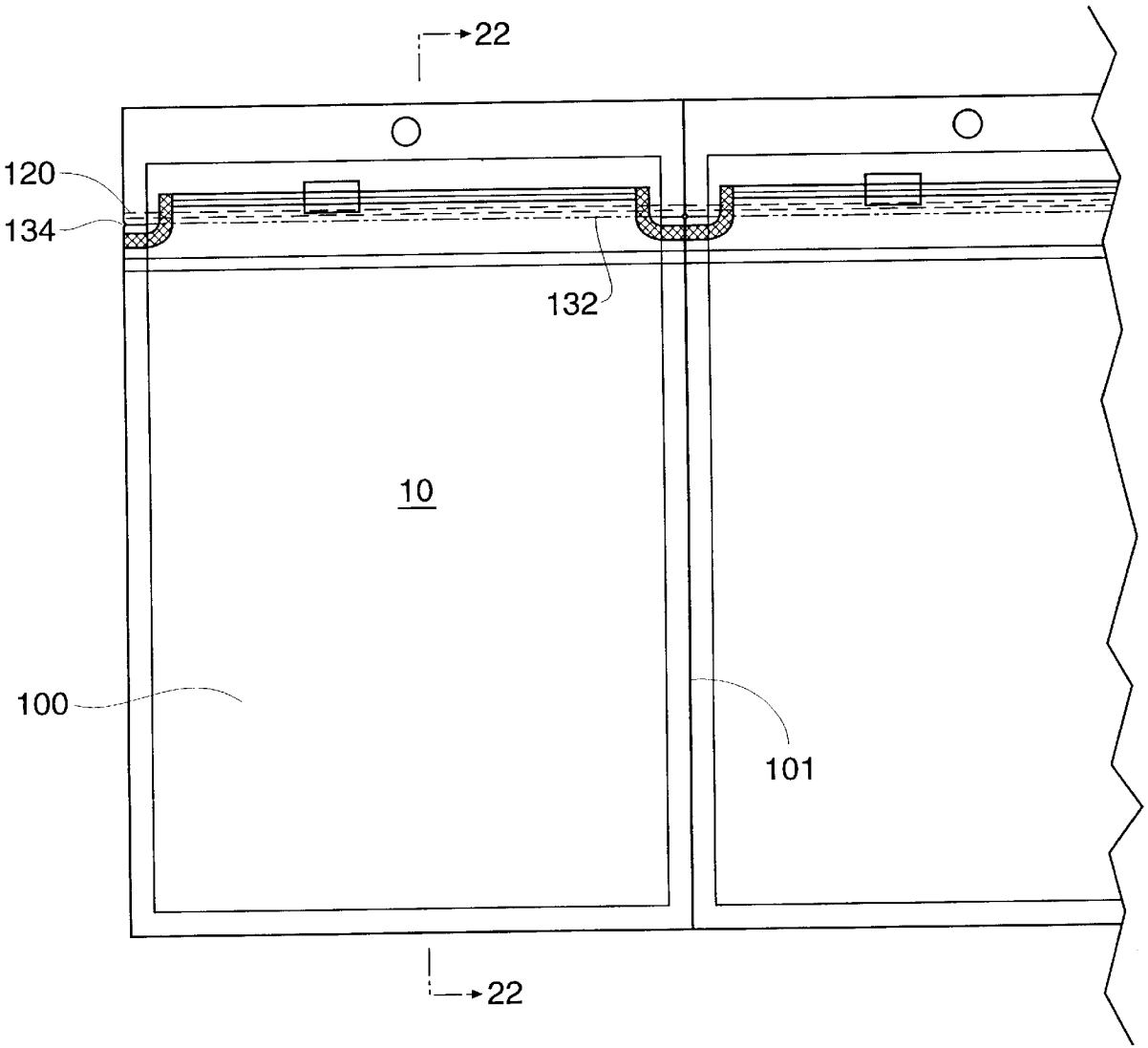
FIG. 21 is a plan view of an alternative embodiment of the present invention illustrating various features of the invention including die cutting of the track mass of the zipper assembly and the use of a tear structure like a tear tape or a tear string.
Figure 22:
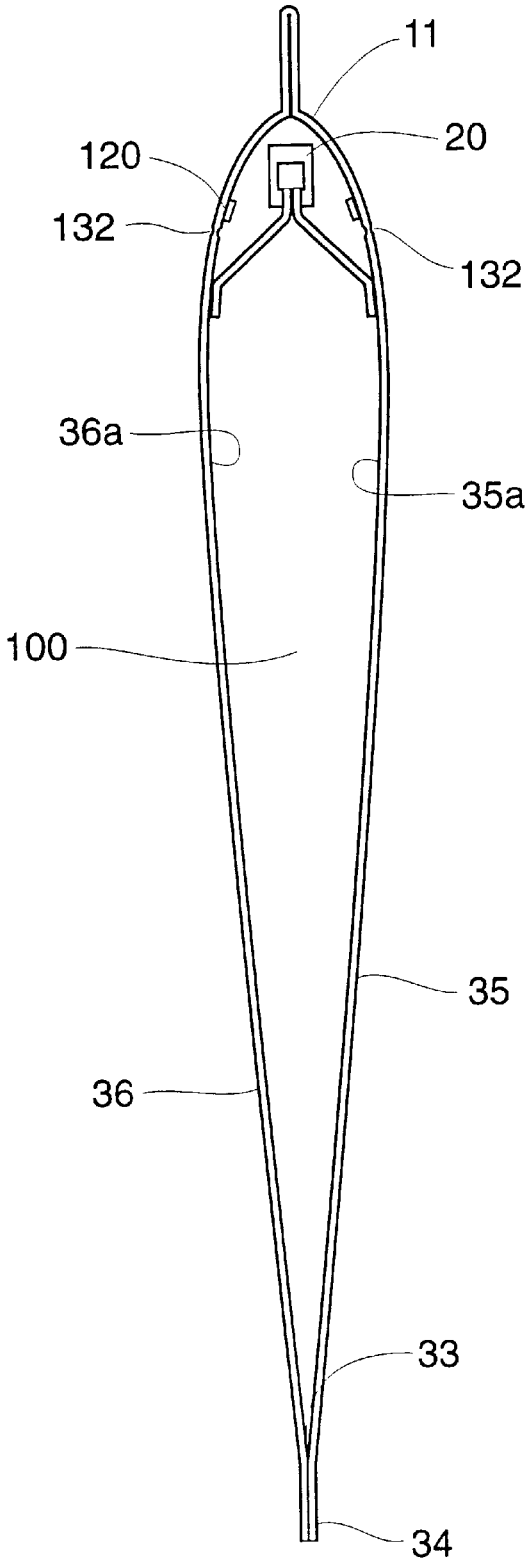
FIG. 22 is a view from line 22—22 of FIG. 21.

Referring to FIGS. 21 and 22, at least one but preferably two pieces of tear tape 120, located between the front side 35 and back side 36 of the parent film material 10 on film surfaces 35*a* and 36*a*, of a predetermined size are bonded or sealed to the parent film 10 of the hood structure 11 adjacent, preferably just above, a tear line 132 (area of structural weakness). This tear line 132 has the predetermined propensity to tear in predetermined way. The tear tape material 120 adjacent the tear line 132 facilitates tearing off the hood structure 11 from the bag 100 along the tear line 132 in a controlled manner. The optional tear notch 134 facilitates initiation of the tear, the tear line 132 (the oriented parent film or film with the propensity to tear) directs the tear, and the tear tape 120, which is bonded or sealed to the front side 35 and back side 36 of the parent film 10, controls the tear so that the zipper structure 20*a* is consistently clear of the parent film material 10 after the removal of the hood structure 11. Alternatively, if the tear tape material 120 is made of an oriented polypropylene having at least one side with a heat sealable sealant then the parent film 10 would not necessarily need to be oriented or have the tear line 132 or propensity to tear.

Figure 28:
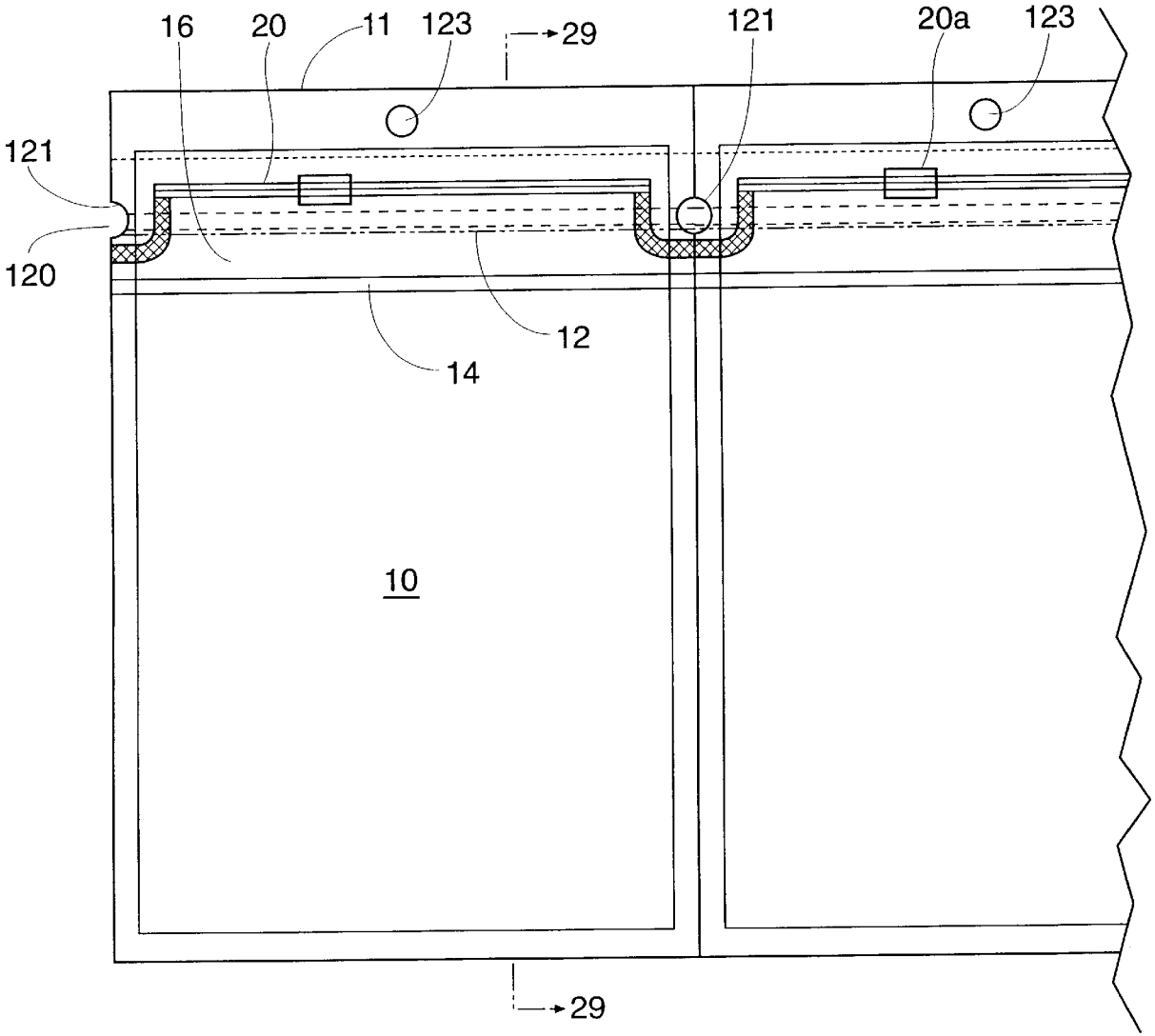
FIG. 28 is a plan view of an alternative embodiment of the present invention illustrating various features of the invention including the use of an optional header strip and the use of an optional opening to assist in removal of the hood and exposure of the zipper assembly.
Figure 29:
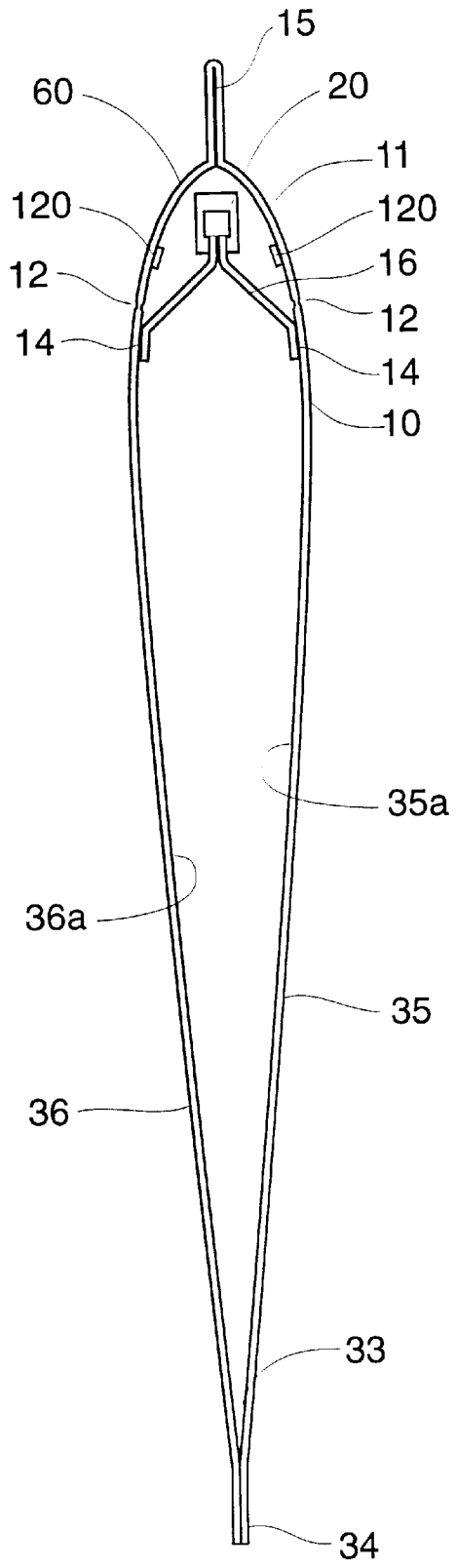
FIG. 29 is a view from line 29—29 of FIG. 28.

With respect to facilitating removal of hood or fold 11 it should be understood that instead of score lines 12 the parent film 10 may be weakened in predetermined areas using other procedures as well, including but not limited to scoring or the use of multi-ply laminate film having a predetermined weakened area or the addition of a tear assistance structure, e.g., Tear tape 120 or tear string 120*a*. The tear assistance structure may be added for use by itself or in conjunction with a predetermined area of structural weakness 12 to aid in the tearing of the film 10. See FIGS. 28 and 29.

Figure 23:
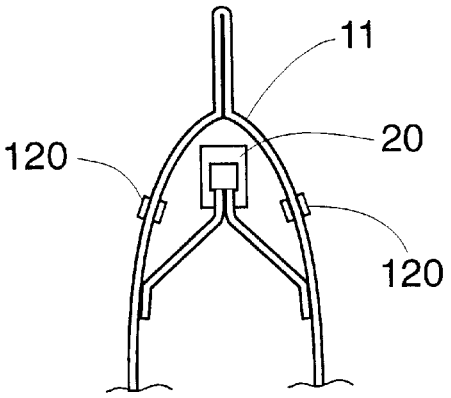
FIG. 23 is a view of an alternative to the embodiment shown in FIG. 22 wherein tear tape is applied to both the inside and outside surface of the bag.

Referring to FIG. 23 another alternative to the embodiment disclosed in FIG. 22 is disclosed. In this embodiment tear tape 120 is applied to both the inside surfaces 36*a* and 35*a* and the outside surfaces 36 and 35 of the bag 100. In this embodiment no score line or weakening 132 is believed necessary (although such an area of structural weakness could be used) since the tear tape 120 located on both the inside and outside surfaces of the bag 100 will act as an effective tear guide.

Figure 24:
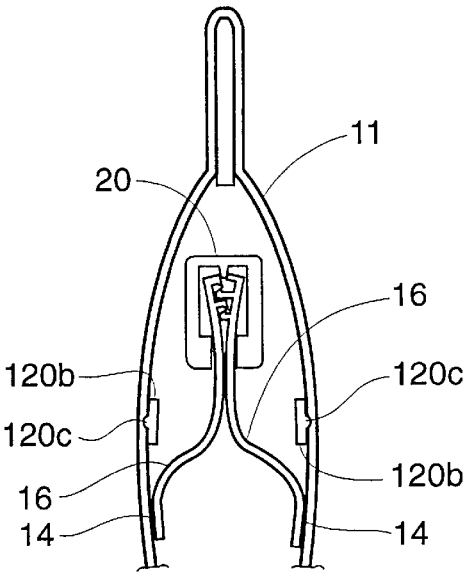
FIG. 24 is a cut-away view of an alternative to the embodiment shown in FIG. 22 wherein the tear tape includes a tear bead.
Figure 25:
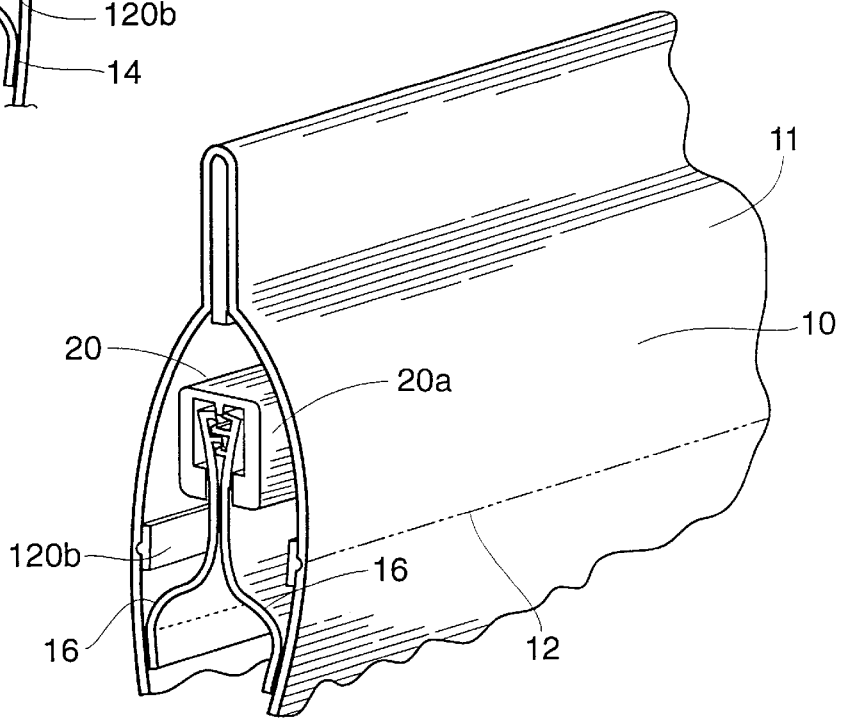
FIG. 25 is a perspective view of the embodiment shown in FIG. 24.
Figure 26:
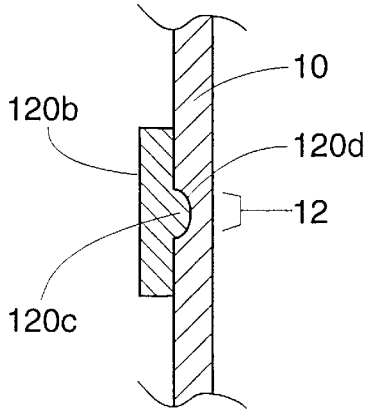
FIG. 26 is a cut-away view of a predetermined portion of the embodiment shown in FIG. 24 illustrating the tear tape and tear bead's relationship to the film and the area of structural weakness created as a result of the presence of the tear bead.

Referring to FIGS. 24, 25, and 26 another alternative to the embodiment shown in FIG. 22 is illustrated. In this embodiment a modified tear tape 120*b* having a tear bead 120*c* is used.

As FIGS. 24–26 illustrate, when the film 10 is sealed to the tear tape 120*b* the bead 120*c* is depressed into the film 10 creating an area of structural weakness 12 without requiring prescoring or other modification of the parent film 10 prior to the application of the tear tape 120*b*. This structure is believed beneficial because the tear tape 120*b* is always in alignment with the area of structural weakness 12.

Figure 27:
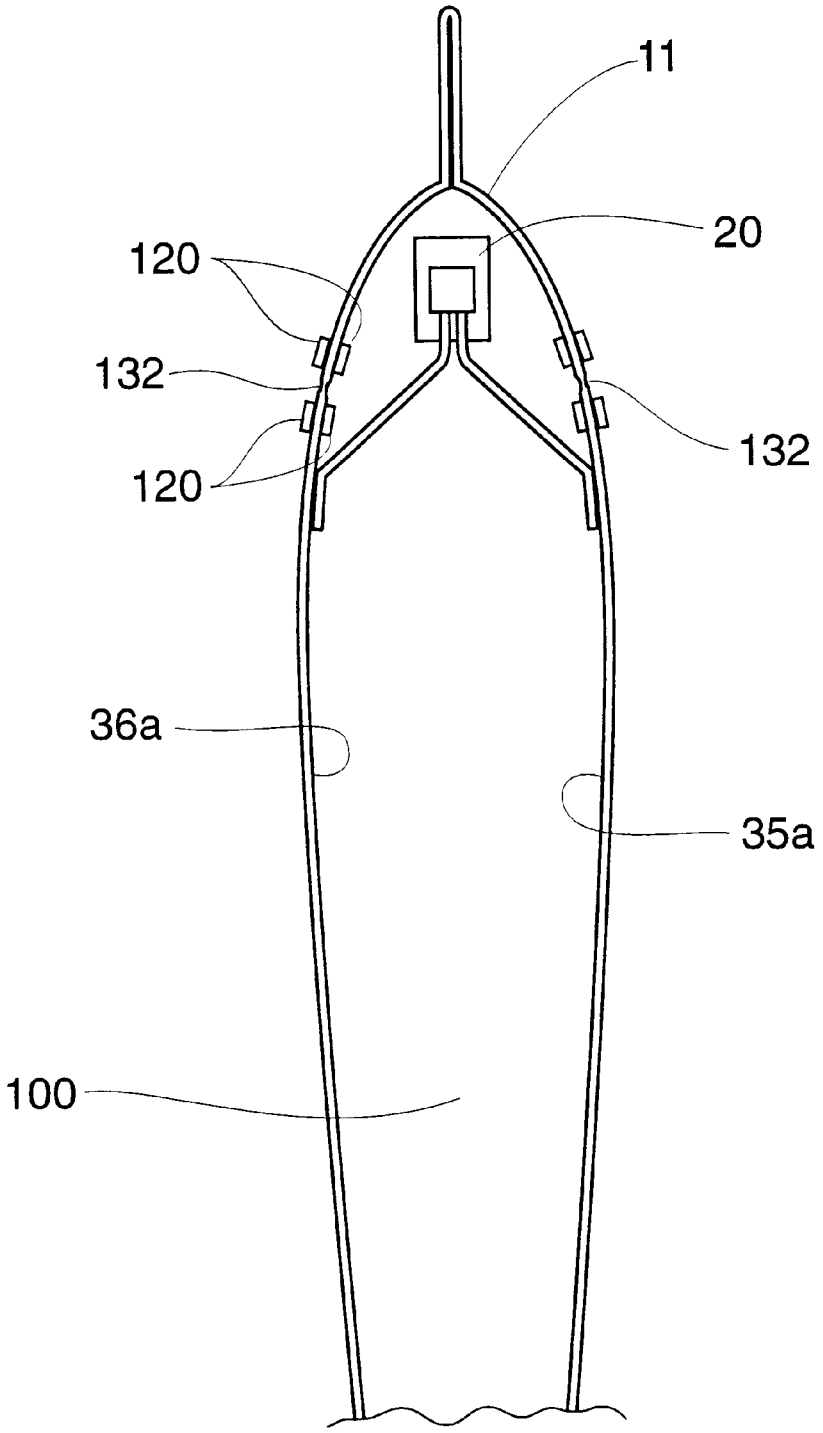
FIG. 27 is an alternative embodiment to the structure disclosed in FIG. 22.

Referring to FIG. 27 another alternative to the embodiment disclosed in FIG. 22 is disclosed. In this embodiment tear tape 120 is applied to both the inside surfaces 36*a* and 35*a* and the outside surfaces 36 and 35 of the bag 100. The tear tape 120 is applied to border both sides of the score line or weakening 132. Since the tear tape 120 is located on both sides of the score line 132 and on the inside and outside surfaces of the bag 100 a very consistent controlled or guided will be achieved.

Tear tape 120 is interchangeable with tear string 120*a*. Accordingly, a tear string 120*a* could be substituted for the tear tape 120. See, e.g., FIGS. 38 and 39. Preferably, the tear tape 120 or the tear string 120*a* used is made from a material, e.g., Thermoplastic material, that is compatible with the film 10 and which may be sealed, coupled, or bonded to the film 10. For example, the tear tape 120 or tear string 120*a* may be formed of polyethylene or may be encased in polyethylene. It is understood in the art that a tear string, such as tear string 120*a*, may have various cross-sectional shapes, e.g., Round, square, triangular, etc., which may be used to enhance its ability to tear the parent film material 10.

Figure 32:
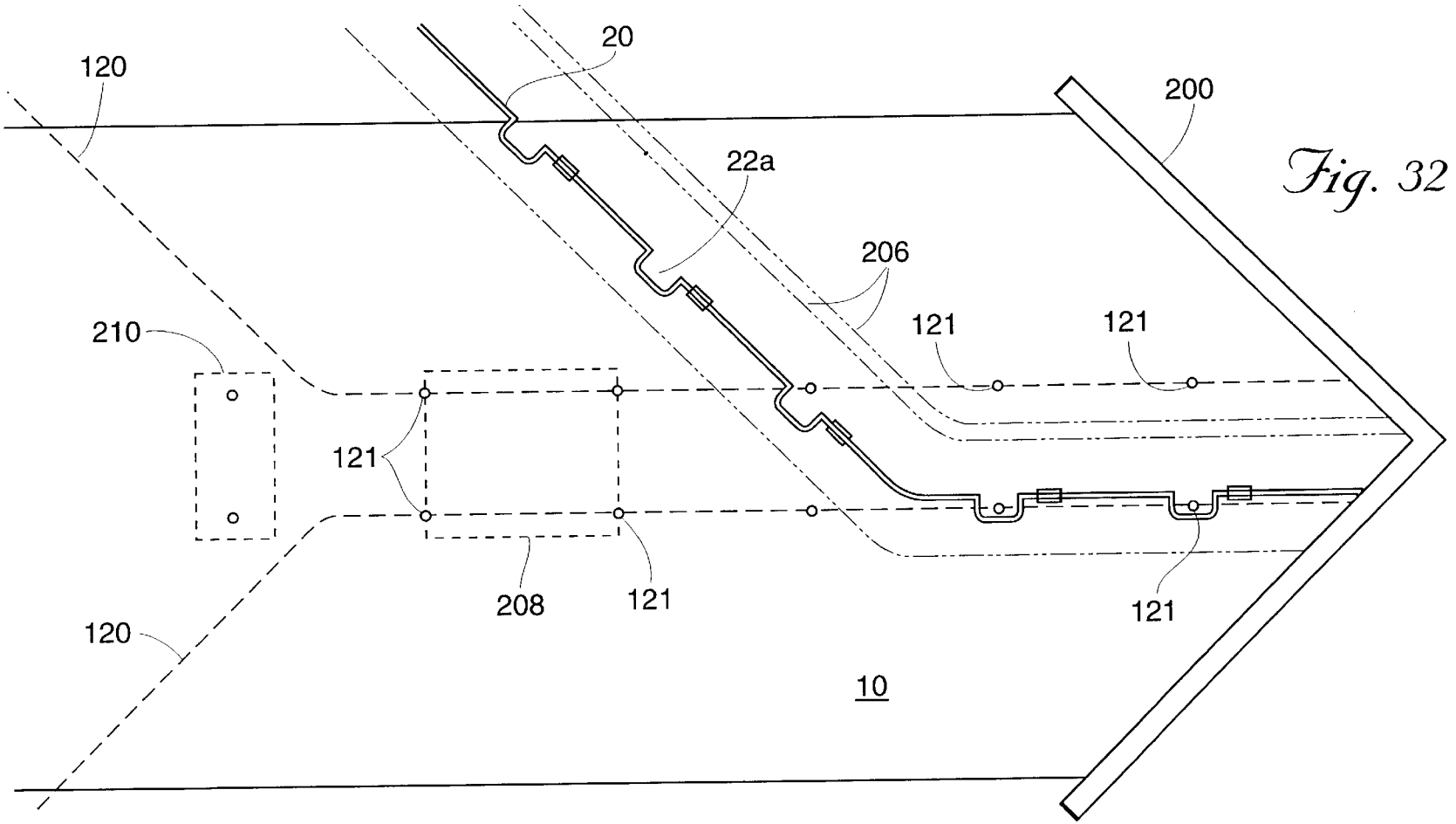
FIG. 32 is a schematic top plan view illustrating at least one method by which the components of the alternative embodiment disclosed in FIG. 30 are introduced prior to the plow mechanism of the form fill and seal machine.
Figure 35:
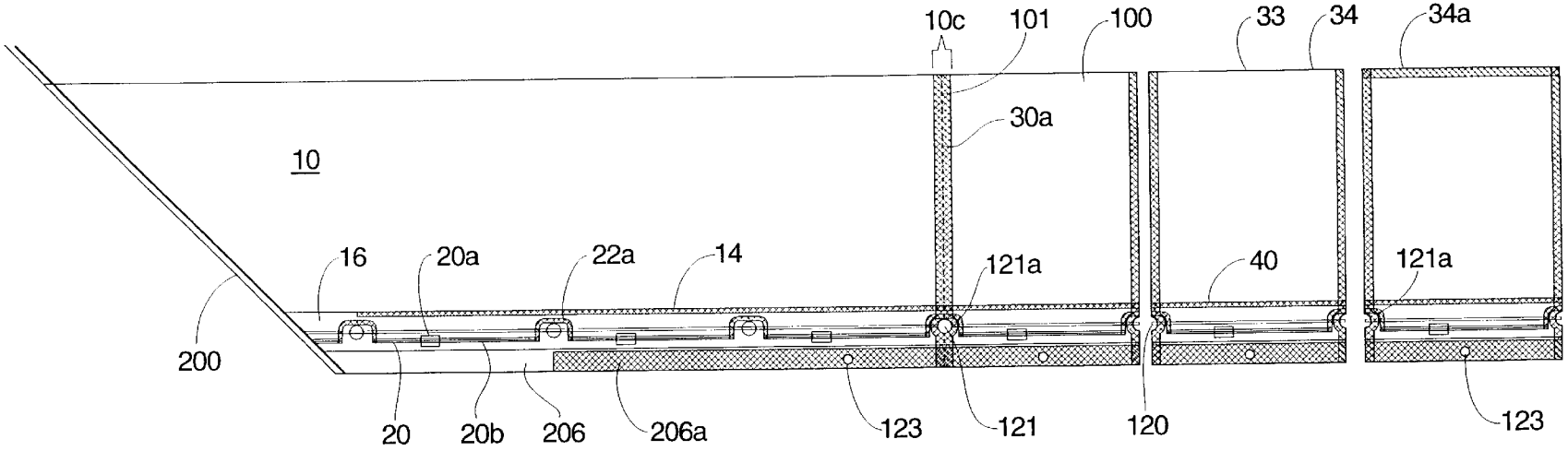
FIG. 35 is side elevational schematic view illustrating the steps of construction of the alternative embodiment disclosed in FIG. 30 subsequent to folding the parent film on the plow structure.

In particular, referring to FIGS. 30, 32, and 35, the process by which the alternative embodiment having tear tape 120 is presently believed to be manufacturable is illustrated using an rpm 100 machine. The parent film 10 is fed over a predetermined number of rollers and toward the plow structure 200. The parent film 10 after passing over dancer roller 203*a* is die punched by die 210 to present parallel openings 121. It is presently believed that the film 10 must pass over the dancer rollers 203*a* so that they are kept sufficiently taught thus allowing openings 121 to be punched out accurately at predetermined positions, by die 210, such that the positions of the openings 121 are always at the same or a uniform distance from each other. In addition to the parent film 10 two rolls of tear tape 120 are feed over the parent film 10 and in parallel alignment with the parallel openings 121 such that the tear tape 120 preferably, but not necessarily, bisects each the parallel opening 121. Tear string 120*a* could be substituted for tear tape 120. See, e.g., FIGS. 38 and 39.

In addition, referring back to FIGS. 30, 32, and 35, optionally a header material 206 may be fed over the parent film 10. Further, the zipper or slider assembly 20 is also fed over the parent film 10. Prior to being fed over the parent film 10 the zipper assembly 20 has a notch 22*a* die punched, by die 214 and heat sealed by sealer 216, at a predetermined position that is also designed to be in general alignment with the parallel openings 121. Once the tear tape 120 is presented over the parent film 10 but before it is passed over the plow 200 it passes over a tear tape sealer mechanism 208 so that the tear tape 120 is sealed to the parent film 10. Alternatively, the tear tape 120 could be tacked in place and subsequently sealed to the parent film 10 either before or after the plow 200.

Figure 37:
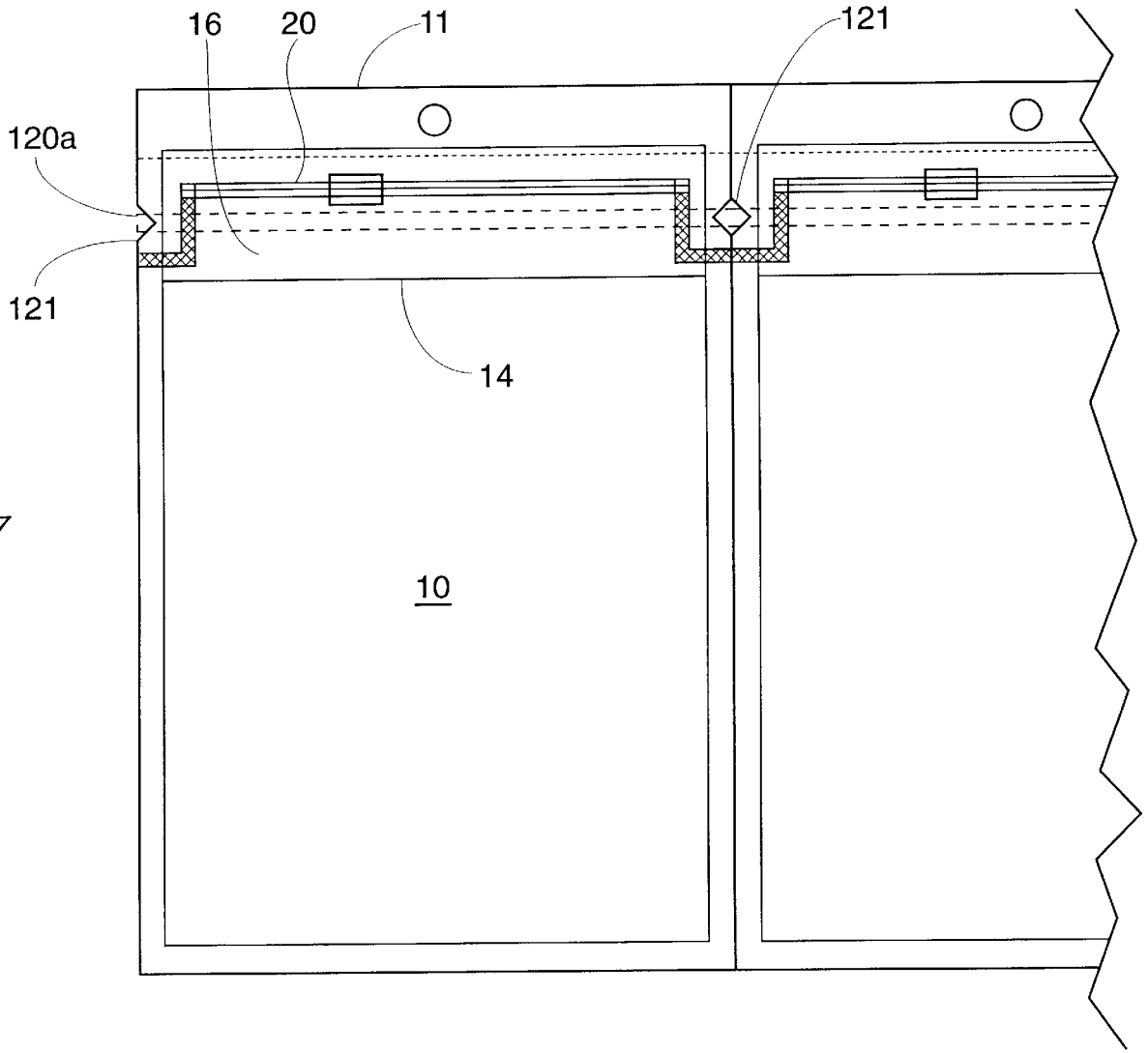
FIG. 37 is an alternative embodiment of the present invention illustrating various features of the invention including the use of tear string and a diamond shaped opening as opposed to a circular opening for assisting in the removal of the hood and exposing the zipper assembly.

The parallel openings 121 may be of any shape although circular is the shape that is presently preferred. Diamond shaped cuts could be used to further enhance initiation of the tear in the parent film 10. See FIG. 37.

Additionally, the notch 22*a* as generally illustrated herein may be of an arcuate or radiused shape but the notch 22*a* could also be made at a sharp angle such as a 90° angle. See FIG. 37. The sharper angle is presently believed to add more stress to the structure of the zipper assembly 20 and therefore a radiused structure is presently considered to be preferred. However, the present invention should not be interpreted as being limited to solely a radiused notch 22*a* as generally illustrated herein.

After the parent film 10 is folded the remaining manufacturing process is carried out as generally illustrated in FIG. 35. The zipper skirts 16 are sealed to the respective sides of the parent film 10 at seal 14. The header strip 206, if used, is sealed to the parent film 10 at seal 206*a*. The side seal 30*a* is made, which also seals the perimeter or edge 121*a* of opening 121. (note, if no tear tape 120 or tear string 120*a* is used then it is presently considered best to add a tear notch 24 to the opening 121 to facilitate removal of the hood 11.) An opening 123 is die punched in the package 100 to provide a point where the package 100 may be easily hung for display purposes. The package 100 is then cut along seam 101 from the V-fold portion of the form fill and seal machine and transferred to the fill and seal stations where fill opening 33 is opened and the package 100 is filled and gas is flushed through the fill opening 33. Opening 33 is then hermetically sealed at seal 34*a*.

Figure 38:
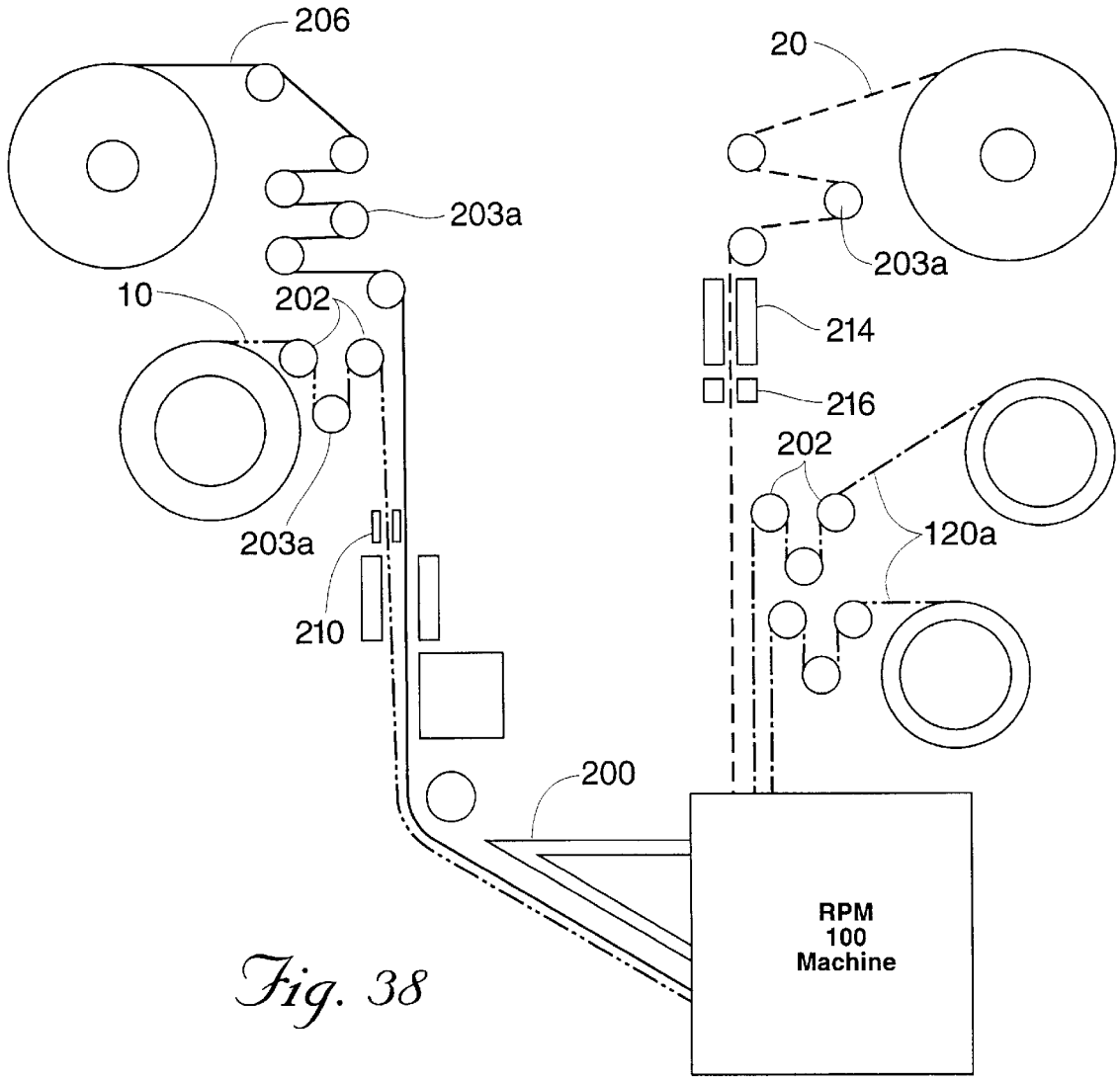
FIG. 38 is a schematic diagram showing the components of another alternative embodiment of the present invention being fed into a machine suitable for adaptation to perform the process and make the product disclosed herein, wherein either a tear string or the zipper assembly are introduced to the parent film after the plow.
Figure 39:
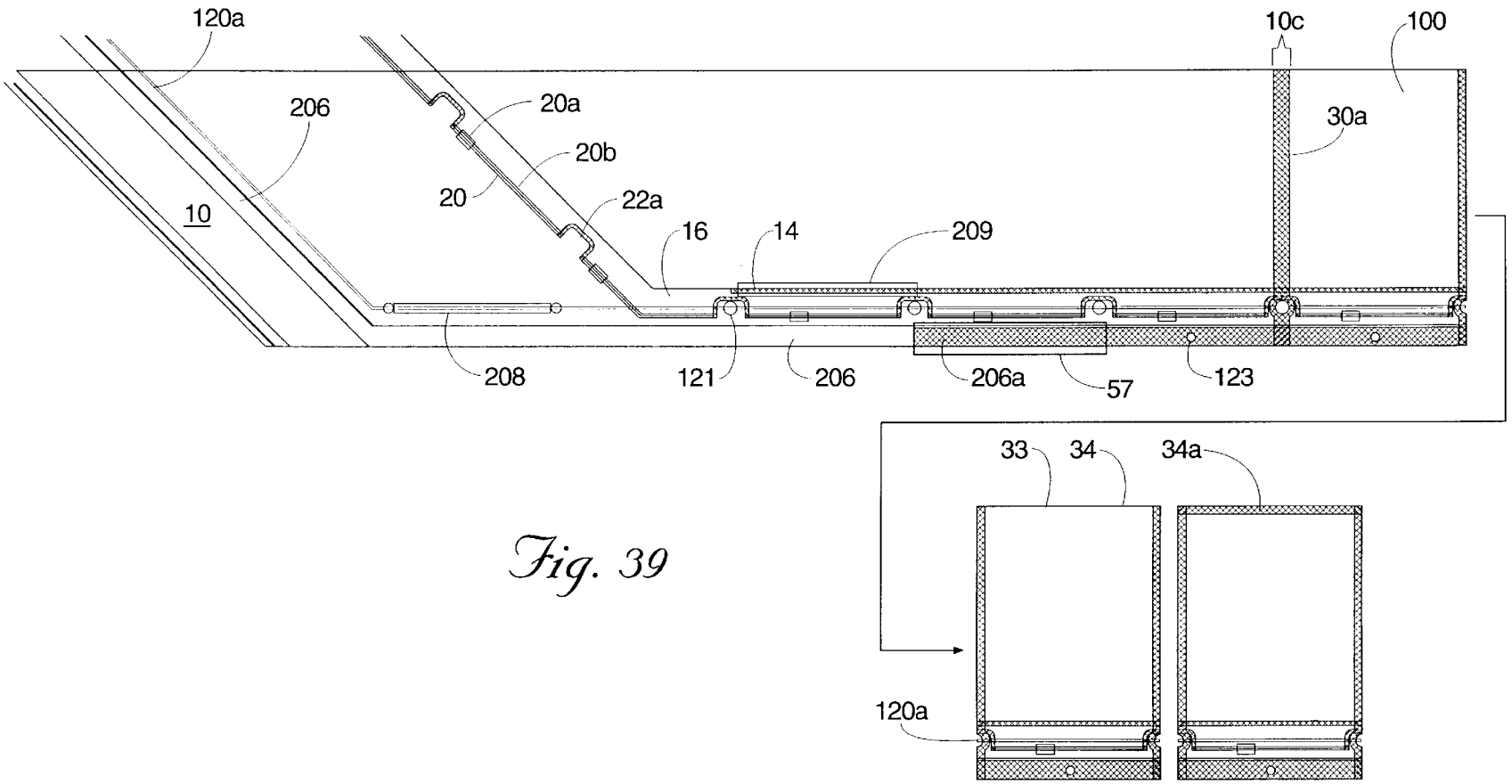
FIG. 39 is a side elevational schematic view illustrating the steps of construction of the alternative embodiment disclosed in FIG. 38 wherein the tear string or slider or zipper assembly is introduced after the plow structure.

Alternatively, referring to FIG. 38 and FIG. 39 the zipper assembly 20 may be introduced subsequent to the plow structure 200. The parent film 10, prior to being fed over the rollers 202 is still die punched by die 210 to present parallel openings 121. Also, alternatively, the tear tape 120 or tear string 120*a* may be feed over the parent film 10 and in parallel alignment with the parallel openings 121 subsequent to the plow 200. See FIGS. 38 and 39. Again, the tear tape 120 or tear string 120*a* preferably, but not necessarily, bisects each parallel opening 121. Also, while FIG. 39 shows both the tear string 120*a* and skirts 16 of the zipper assembly 20 being introduced to the parent film 10 subsequent to the plow 200 and respectively sealed by sealer bars 208 and 209 it should be understood that either the tear string 120*a* or the zipper assembly 20 could be introduced before the plow 200. For example, the zipper assembly 20 could be introduced after the plow 200 and the tear string 120*a* prior to the plow 200. Since tear tape 120 is interchangeable with the tear string 120*a* it will be apparent to a person of ordinary skill in the art reading this disclosure that the tear tape 120 could also be introduced after the plow 200 and used in essentially the same manner as the tear string 120*a*.

The openings 121 are provided, at a minimum, to facilitate access to the tear tape 120 or the tear string 120*a* and to facilitate tearing and removal of the hood 11 to expose the zipper assembly 20.

Additionally, the present invention may be used in combination with other VFFS and HFFS machines. The present invention could also be used with HFW machines. However, in using either VFFS machines or HFFS machines the method of the present invention is presently believed to require post-compression (commonly called post-squashing) of a predetermined portion of the track structures 20*b*, with respect to the embodiment shown in FIG. 6. (sometimes also referred to as track mass 20*b*, herein) of the slider closure assembly 20 located within a margin or line 10*b* of the parent film 10 where a seal 30*a*, especially a hermetic seal, is desired. Alternatively, the track mass 20*b* may have a pre-compressed portion located with margin lob. Neither pre-compression nor post-compression are believed to be required where a notch, e.g., 22*a* of FIG. 7, has been punched out or cut from the zipper assembly 20. However, if pre-compression is desired then this is accomplished in the present invention at sealer 216 shown in FIG. 30. This is so that when, on either a HFFS or VFFS machine, the track mass 20*b* (with the slider or zipper structure 20*a* avoided) passes through the package side seal zone portion of either the machine a consistent hermetic seal 30*a* is produced by the application of the heater bars of the machine used. As will be apparent to a person of ordinary skill in the art from this disclosure, if a notch, e.g., notch 22*a* of FIG. 7, is cut from the zipper assembly 20 then there is no structure or mass for sealer 216 to pre-compress and sealer 216 will then only provide seal 22*b* of the cut end 22, as shown in FIG. 7.

In applications using HFW machines for the manufacture of the embodiment shown in FIG. 5, such as Jones Automation Company machines, it is not believed necessary to pre-compress, post-compress, or squash a predetermined portion of the track mass 20*b*. HFW machines have a rotary jaw assembly, which includes a hinged side. The jaw assembly provides at least two advantages, either of which, separately or in combination, eliminates the need for pre-compression of the track mass 20*b*. First, the jaw assembly provides a relatively long time, longer than the time provided by either VFFS or HFFS machines, for the application of heat and pressure sufficient to form the desired seal 30*a*. Second, the portion of the track mass 20*b* that is targeted to be fused or sealed. (generally located within the boundary of margin 10*b*) is placed or fed into the jaw assembly so that it is placed toward and near the hinged portion of the jaw assembly and thus maximum mechanical advantage and force may be applied to the predetermined portion of the track mass 20*b*.

If either the longer seal time or the mechanical advantage of the jaw assembly of the HFW machine was not available then, referring to FIG. 6, since there is generally insufficient room on an HFW machine to pre-compress the track mass 20*b*, the track mass 20*b* may be pre-punched with a die at the predetermined location 22*a* (where the seal 30*a* is also to be applied or created) prior to insertion into the fold 11 of the parent film 10. Since the pre-punched area or notch 22*a* would be synchronized to be in registration with the portion of the folded parent film 10 that is to be sealed, less energy (time, temperature, and/or pressure), due to the reduced mass to be sealed is required to consistently obtain the type of seal 30*a* desired. (note, pre-punching rather than pre-compression could also be used with HFFS or VFFS machines.)

The foregoing is considered as illustrative only of the principles of the invention. Furthermore, since numerous modifications and changes will readily occur to those skilled in the art, it is not desired to limit the invention to the exact construction and operation shown and described.

What is claimed is:

1. A method of manufacturing a reclosable bag for filling with at least one food product said reclosable bag comprising:

at least one sheet of web material including a first area of structural weakness and a second area of structural weakness; said sheet of web material including at least one fold structure located between and defined by said first and second areas of structural weakness, and a fill opening;

said sheet of web material including a first panel coupled to said fold structure adjacent said first area of structural weakness and a second panel coupled to said fold structure adjacent said second area of structural weakness; a reclosable fastener structure including a male track structure and a female track structure; said male track structure including a first skirt structure of web material extending therefrom and said female track structure including a second skirt structure of web material extending therefrom; each said skirt structure including a predetermined coupling portion; said coupling portion of said first skirt structure being coupled to said first panel and said coupling portion of said second skirt structure being coupled to said second panel; said reclosable fastener structure extending past said areas of structural weakness and into said fold structure; said areas of structural weakness being located on said material between said reclosable fastener structure and said coupling portions;

said reclosable bag capable of being filled with at least one food product through said fill opening, said method comprising:

providing a sheet of web material having a first area of structural weakness and a second area of structural weakness;

folding said sheet of web material along a predetermined folding area located between said areas of structural weakness to form said fold structure and said fill opening;

providing a reclosable fastener having at least one skirt structure including a predetermined coupling portion;

inserting said reclosable fastener into said fold structure and locating said reclosable fastener at a position between said areas of structural weakness and said folding area;

coupling said predetermined coupling portion of said at least one integral skirt structure to a location on said web material on the side of the structural weakness opposite said fold area;

sealing said web material along at least two predetermined linear areas located generally perpendicular to said fold structure;

filling said reclosable bag with at least one food product through said opening; and sealing said opening.

2. The method of claim 1 wherein the step of sealing said web material along at least two predetermined linear areas occurs last.

3. The method of claim 1 wherein the first step is coupling at least one predetermined portion of said distal margin of said at least one integral skirt structure to at least one predetermined portion of said web material prior to folding said sheet of web material.

4. The method of claim 1 including the further step of inserting and sealing a header material into said predetermined fold area at least prior to the step of sealing said web material along at least said two predetermined linear areas.

5. The method of claim 1 including the further step of inserting and sealing at least one tear structure into said predetermined fold area at least prior to the step of sealing said web material along at least said two predetermined linear areas.

6. The method of claim 1 including the further step of sealing a predetermined portion of said fold structure and forming a header structure; said further step being subsequent to said step of folding said sheet of web material along a predetermined folding area located between said areas of structural weakness to form said fold structure.

7. A method of manufacturing a reclosable bag for filling with at least one food product, said reclosable bag including at least one sheet of web material having at least one predetermined tear area, at least one fold structure, and an opening located generally opposite said fold structure; a reclosable fastener assembly including at least one integral skirt structure of skirt web material extending therefrom; said integral skirt structure including at least one distal margin; said distal margin being coupled to said web material at, at least one location between said tear area and said opening; said reclosable fastener structure extending past said tear area and into said fold structure; said tear area being located on said web material between said reclosable fastener assembly and said distal margin said reclosable bag capable of being filled with at least one food product, said method comprising:

providing a sheet of web material having at least one predetermined tear area;

folding said sheet of web material along a predetermined folding area to produce said fold structure and said fill opening;

providing a reclosable fastener assembly having at least one integral skirt structure, said skirt structure including at least one distal margin;

inserting said reclosable fastener assembly into said fold structure and locating said reclosable fastener assembly at a position between said predetermined tear area and said folding area;

coupling said distal margin of said integral skirt structure to a location on said web material on the side of the tear area opposite said fold structure;

sealing said web material along at least two predetermined linear areas located generally perpendicular to said fold structure;

filling said reclosable bag with at least one food product through said opening; and sealing said opening.

8. The method of claim 7 wherein the step of sealing said web material along at least two predetermined linear areas occurs last.

9. The method of claim 7 wherein the first step is coupling at least one predetermined portion of said distal margin of said integral skirt structure to at least one predetermined portion of said web material prior to folding said sheet of web material.

10. The method of claim 7 including the further step of inserting and sealing a header material into said predetermined fold area at least prior to the step of sealing said web material along at least said two predetermined linear areas.

11. The method of claim 7 including the further step of inserting and sealing at least one tear structure into said predetermined fold area at least prior to the step of sealing said web material along at least said two predetermined linear areas.

12. The method of claim 7 including the further step of sealing a predetermined portion of said fold structure and forming a header structure; said further step being subsequent to said step of folding said sheet of web material along a predetermined folding area located between said areas of structural weakness to form said fold structure.

* * * * *